US011415088B1

(12) United States Patent
Jonson

(10) Patent No.: US 11,415,088 B1
(45) Date of Patent: Aug. 16, 2022

(54) SYSTEMS AND METHODS FOR REDUCTION OF EMISSIONS AND IMPROVING THE EFFICIENCY OF DIESEL INTERNAL COMBUSTION ENGINES

(71) Applicant: C. Hugh Jonson, Coupeville, WA (US)

(72) Inventor: C. Hugh Jonson, Coupeville, WA (US)

( * ) Notice: Subject to any disclaimer, the term of this patent is extended or adjusted under 35 U.S.C. 154(b) by 0 days.

(21) Appl. No.: 15/724,910

(22) Filed: Oct. 4, 2017

Related U.S. Application Data

(60) Provisional application No. 62/433,584, filed on Dec. 13, 2016.

(51) Int. Cl.
*F02M 27/04* (2006.01)
*C25B 1/04* (2021.01)
*F02M 25/028* (2006.01)

(52) U.S. Cl.
CPC ..... *F02M 27/04* (2013.01); *C25B 1/04* (2013.01); *F02M 25/028* (2013.01)

(58) Field of Classification Search
CPC ..... Y02E 60/50; Y02E 60/36; Y02T 10/30; Y02T 10/12; Y02T 90/40; H01M 8/04089; H01M 8/04559; H01M 2300/0002; H01M 8/08; F02B 43/10; F02B 2043/106; F02B 43/08; F02B 51/04; F02B 51/02; F02D 19/0671; F02M 27/04
USPC ..... 123/3, 575–578, 538
See application file for complete search history.

(56) References Cited

U.S. PATENT DOCUMENTS 4,822,469 A * 4/1989 Shimomura ..... C25B 15/02 204/278
5,037,518 A * 8/1991 Young ..... C25B 1/04 204/266
2009/0071819 A1* 3/2009 Rusta-Sallehy ..... C25B 1/04 204/228.5
2009/0120414 A1* 5/2009 Hallenbeck ..... F02M 25/12 123/3
2011/0089029 A1* 4/2011 Volk, Jr. ..... C25B 11/00 204/276
2013/0220240 A1* 8/2013 Jonson ..... F02M 25/12 123/3
2017/0275160 A1* 9/2017 Carter ..... C01B 13/0207

* cited by examiner

*Primary Examiner* — George C Jin
*Assistant Examiner* — Teuta B Holbrook
(74) *Attorney, Agent, or Firm* — Kirton McConkie; Brian Tucker

(57) ABSTRACT

A system for improving efficiency of an internal combustion engine includes an electronic controller generating an RF signal and an electrolysis reactor electrically connected to the electronic controller. The electrolysis reactor includes a plurality of substantially parallel plates arranged in a stack. The plurality of plates includes a central positive plate, a first positive end plate, and a second positive end plate. The plurality of plates also includes a first negative plate located in the stack equidistantly between the central positive plate and the first positive end plate, and a second negative plate located in the stack equidistantly between the central positive plate and the second positive end plate. The plurality of plates further includes a plurality of neutral plates. The system also includes an aqueous solution flowing through the electrolysis reactor, the solution containing an electrolyte.

20 Claims, 14 Drawing Sheets

SYSTEMS AND METHODS FOR REDUCTION OF EMISSIONS AND IMPROVING THE EFFICIENCY OF DIESEL INTERNAL COMBUSTION ENGINES

CROSS-REFERENCE TO RELATED APPLICATIONS

This application claims the benefit of U.S. Provisional Application No. 62/433,584, filed Dec. 13, 2016, which is incorporated herein by reference for all it discloses.

BACKGROUND OF THE INVENTION

1. Field of the Invention

The present invention relates to internal combustion engines such as diesel engines, and more particularly to systems and methods for reducing emissions and improving the efficiency of diesel internal combustion engines.

2. Background and Related Art

Worldwide emissions, stemming primarily from the burning of fossil fuels, are reaching the highest levels ever recorded. By some measures, the emissions associated with burning fossil fuels have already reached nearly 5 metric tons per person per year. Internal combustion engines, including diesel engines, are a major contributor of fossil fuel emissions. By some measures, there are over 300 million diesel engines worldwide contributing to such emissions.

Internal combustion engines, and diesel engines in particular, emit particulate matter (PM) and governments around the world are realizing that these emissions are a cause for great concern. As a result, many countries/jurisdictions, including the United States, the European Union and China, are passing regulations which require significantly reduced emissions from internal combustion engines, including diesel engines.

Accordingly, more and more, businesses are forced to comply with these new air quality standards at their own expense. Sometimes, the costs for modifying large fleets of vehicles to meet new regulations can exceed US $30,000 per vehicle.

An attributable amount of emissions created by internal combustion engines is a result of the internal combustion engines failure to convert all of the energy available in the hydrocarbon fuel (e.g., gasoline and/or diesel fuel). This incomplete conversion is often a result of what is commonly referred to as incomplete combustion of the fuel. Incomplete combustion results in an unnecessary loss of fuel efficiency and an increase in pollution.

Accordingly, it is desirable to have a system and/or method for use with an internal combustion engine that aids in achieving more complete combustion of the hydrocarbon fuel, reduced emissions, and/or better fuel economy, or otherwise improves certain metrics of the internal combustion engine.

BRIEF SUMMARY OF THE INVENTION

Implementation of the invention provides systems and methods for improving efficiency and reducing emissions of internal combustion engines, and in particular diesel internal combustion engines. Implementation of the invention may achieve an improvement in the fuel efficiency of an internal combustion engine, such as a gasoline engine, a diesel engine, a two-stroke engine, a four-stroke engine, combinations thereof, and the like. Implementation further provides for substantially complete combustion of fuel by the internal combustion engine, or at least more-complete combustion of fuel. Because of the more-complete combustion of fuel, the internal combustion engine may have improved operation, such as operating at a cooler temperature and with fewer emissions.

Implementation of the invention may produce a gas mixture from a water electrolysis process, and may deliver the gas mixture to an intake of the internal combustion engine. The generation of the gas mixture may be reliably controlled to provide a gas mixture for combustion according to engine needs (e.g., engine speed, etc.) so as to maximally enhance combustion. Additionally, the generation of the gas mixture may be reliably controlled to prevent a runaway condition in the gas generation system.

Implementation of the invention may alter combustion in the internal combustion engine to reduce particulate formation. The gas mixture generated may act as an accelerant to speed combustion, enhance combustion, and/or increase the extent of combustion. A shorter combustion process may be achieved according to implementation of the invention, which may lower engine temperatures and reduce the formation of nitrogen oxides.

An exemplary system for improving efficiency of an internal combustion engine includes an electronic controller generating an alternating-current (AC) signal having a frequency in a range between 10 MHz and 50 MHz and comprising a positive output and a negative output and an electrolysis reactor electrically connected to the electronic controller. The electrolysis reactor includes a plurality of substantially parallel plates arranged in a stack. The plurality of plates includes a central positive plate centrally located in the stack and electrically connected to the positive output, a first positive end plate electrically connected to the positive output, and a second positive end plate electrically connected to the positive output. The plurality of plates also includes a first negative plate located in the stack equidistantly between the central positive plate and the first positive end plate and electrically connected to the negative output, and a second negative plate located in the stack equidistantly between the central positive plate and the second positive end plate and electrically connected to the negative output. The plurality of plates further includes a plurality of neutral plates, each neutral plate being disposed between one of the positive plates and one of the negative plates, wherein each of the neutral plates is not electrically connected to either of the positive outlet or the negative outlet by a metallic electric connection. The system also includes an aqueous solution flowing through the electrolysis reactor, the solution containing an electrolyte.

An electrical connection between the positive output and each of the positive plates may include an electrical wire between the electronic controller and the electrolysis reactor and an electrical connection between the negative output and each of the negative plates may include an electrical wire between the electronic controller and the electrolysis reactor.

Each plate in the stack may be separated from each immediately adjacent plate in the stack by an incompressible non-conductive spacer. Each spacer may have a border portion extending along an outer edge of its adjacent plates and a central divider extending from one side of the spacer to an opposite side of the spacer. The central divider may divide an inter-plate space between immediately adjacent plates into two fluidly separate elongate chambers. Each plate except the central positive plate may include four fluid passage holes, with one fluid passage hole being disposed at a first end of each elongate chamber, and with one fluid passage hole being disposed at a second end of each elongate chamber. The central positive plate may be substantially impermeable to passage of fluid. A fluid-tight gasket may be disposed around an edge of each elongate chamber between immediately adjacent plates.

A pump may be fluidically connected to the electrolysis reactor to circulate the aqueous solution through the electrolysis reactor. The pump may be of a type having electrical components electrically insulated from the aqueous solution passed through the pump. The pump may have no metal parts in contact with the aqueous solution. The pump may be a diaphragm pump.

The AC signal may have a frequency of between 26 and 36 MHz.

In the system, all components of the system exposed to the aqueous solution may be electrically insulated from a vehicle containing or engine connected to the system, such that the only electrical input to or electrical output from the aqueous solution occurs at the stack of plates where the output of the electronic controller is received.

Another exemplary system for improving efficiency of an internal combustion engine includes an electronic controller generating an AC signal having a frequency in a range between 26 MHz and 36 MHz and comprising a positive output and a negative output and an electrolysis reactor electrically connected to the electronic controller. The electrolysis reactor includes a plurality of substantially parallel plates arranged in a stack. The plurality of plates includes a central positive plate centrally located in the stack and electrically connected to the positive output, a first positive end plate electrically connected to the positive output, and a second positive end plate electrically connected to the positive output. The plurality of plates also includes a first negative plate located in the stack equidistantly between the central positive plate and the first positive end plate and electrically connected to the negative output and a second negative plate located in the stack equidistantly between the central positive plate and the second positive end plate and electrically connected to the negative output. The plurality of plates further includes a plurality of neutral plates, each neutral plate being disposed between one of the positive plates and one of the negative plates, wherein each of the neutral plates is not electrically connected to either of the positive outlet or the negative outlet by a metallic electric connection. The electrolysis reactor also includes a plurality of incompressible non-conductive spacers, with one non-conductive spacer disposed between each pair of immediately adjacent plates. Each spacer includes a border portion extending along an outer edge of its adjacent plates and a central divider extending from one side of the spacer to an opposite side of the spacer and dividing an inter-plate space between immediately adjacent plates into two fluidly separate elongate chambers. The system further includes an aqueous solution flowing through the electrolysis reactor, the aqueous solution including an electrolyte.

A fluid-tight compressible gasket may be disposed around an edge of each elongate chamber between immediately adjacent plates. Each plate except the central positive plate may include four fluid passage holes, with one fluid passage hole being disposed at a first end of each elongate chamber, and with one fluid passage hole being disposed at a second end of each elongate chamber, and wherein the central positive plate is substantially impermeable to passage of fluid from any elongate chamber. A diaphragm pump may be fluidically connected to the fluid passage holes of the first positive end plate and the second positive plate, whereby the diaphragm pump circulates the aqueous solution through four sub-cells of the electrolysis reactor, beginning and ending for two sub-cells with the fluid passage holes of the first positive end plate and beginning and ending for two other sub-cells with the fluid passage holes of the second positive end plate.

The system may also include a tank storing a quantity of the aqueous solution and having a gaseous space above a liquid level in the tank. The system may further include a supply fluid circulation path between a lower end of the tank and the electrolysis reactor, a return fluid circulation path between the electrolysis reactor and an upper end the tank, and an engine supply line extending from the gaseous space of the tank to an engine inlet of an internal combustion engine, the engine supply line including a scrubber to remove liquid from a fluid flowing to the engine inlet from the tank.

The tank may be in close proximity to and vertically spaced above the electrolysis reactor, and the tank may be in close proximity to the internal combustion engine.

An exemplary method for improving efficiency of an internal combustion engine includes a step of providing an electrolysis reactor in close proximity to an internal combustion engine. The electrolysis reactor includes a plurality of substantially parallel plates arranged in a stack. The plurality of plates includes a central positive plate centrally located in the stack and electrically connected to the positive output, a first positive end plate electrically connected to the positive output, and a second positive end plate electrically connected to the positive output. The plurality of plates also includes a first negative plate located in the stack equidistantly between the central positive plate and the first positive end plate and electrically connected to the negative output and a second negative plate located in the stack equidistantly between the central positive plate and the second positive end plate and electrically connected to the negative output. The plurality of plates further includes a plurality of neutral plates, each neutral plate being disposed between one of the positive plates and one of the negative plates, wherein each of the neutral plates is not electrically connected to either of the positive outlet or the negative outlet by a metallic electric connection. The electrolysis reactor further includes a plurality of incompressible non-conductive spacers, with one non-conductive spacer disposed between each pair of immediately adjacent plates. Each spacer includes a border portion extending along an outer edge of its adjacent plates and a central divider extending from one side of the spacer to an opposite side of the spacer and dividing an inter-plate space between immediately adjacent plates into two fluidly separate elongate chambers. The method further includes a step of supplying an AC signal having a frequency in a range between 26 MHz and 36 MHz between the various positive and the various negative plates. The method also includes steps of flowing an aqueous solution including an electrolyte through the electrolysis reactor, whereby a water electrolysis product is formed in the solution and delivering the water electrolysis product to an intake of the internal combustion engine.

The method may include a step of controlling an amperage of the AC signal to prevent heat runaway of the aqueous solution.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
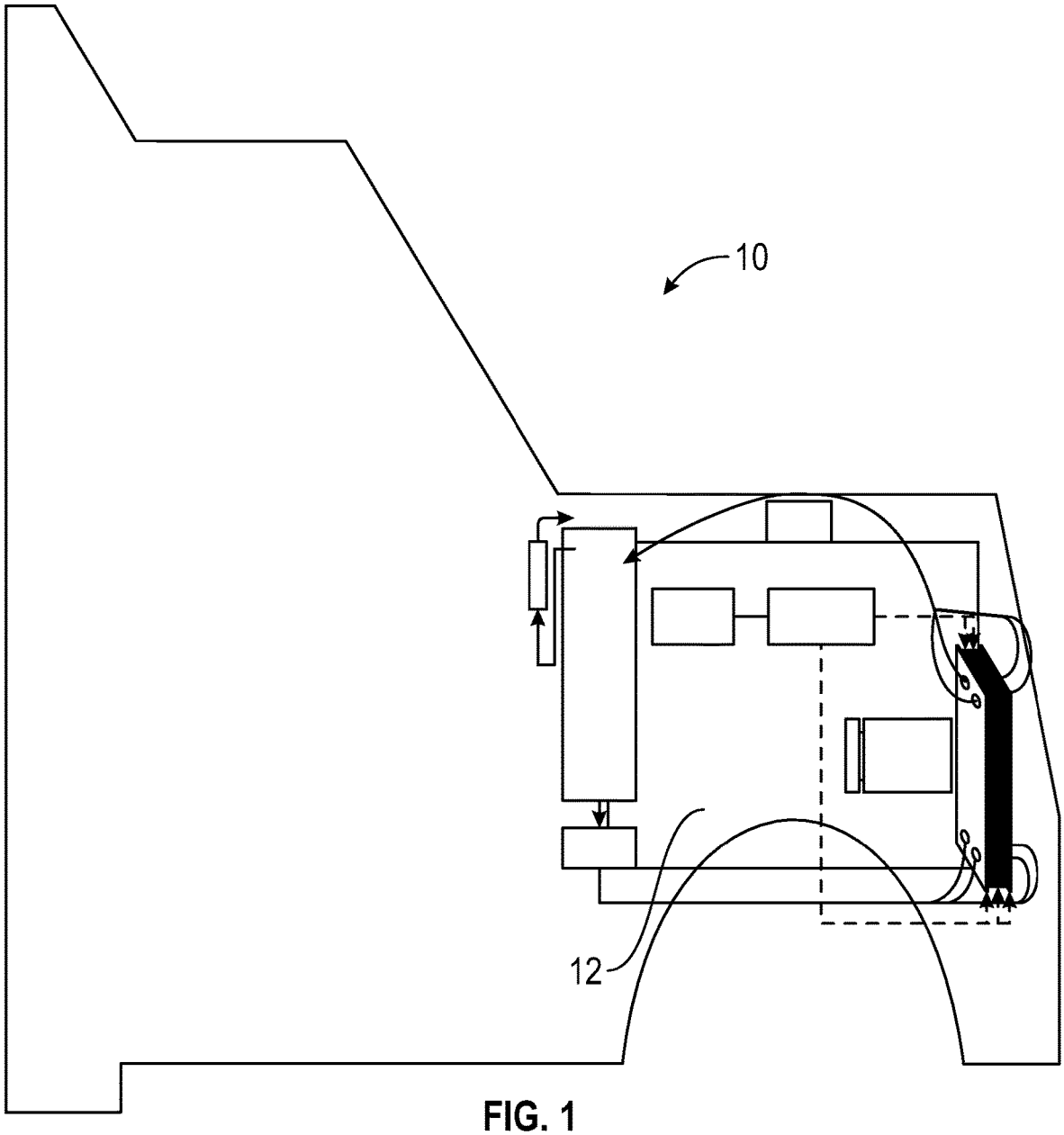
FIG. 1 shows a diagrammatic view of an exemplary vehicle containing an embodiment of a system to increase efficiency of an internal combustion engine.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

In the description, unless otherwise indicated, any numerical range should be understood as encompassing any individual whole or fractional number within the range, including the endpoints, as well as any numerical range falling within the stated numerical range. For example, a stated numerical range of between 5% and 50% includes any individual whole or fractional percentage between 5% and 50%, such as 5%, 6%, 7%, 7.3%, etc., up to 50%, as well as sub-ranges such as 5%-40%, 12%-50%, 17%-27%, and the like. In the description, when numerical values are recited as being "approximate" or "approximately," it should be understood that such numerical values encompass the exact numerical value as well as numerical values that are close to the recited numerical value but not precisely or exactly that numerical value.

Embodiments of the invention provide systems and methods for improving efficiency and reducing emissions of internal combustion engines, and in particular diesel internal combustion engines. Embodiments of the invention may achieve an improvement in the fuel efficiency of any desired type of internal combustion engine, such as a gasoline engine, a diesel engine, a two-stroke engine, a four-stroke engine, combinations thereof, and the like. In some embodiments, fuel efficiency may be improved in any amount between at least approximately 5% and at least approximately 50%.

Embodiments further provide for substantially complete combustion of fuel by the internal combustion engine, or at least more-complete combustion of fuel. Because of the more-complete combustion of fuel, the internal combustion engine may have improved operation, such as operating at a cooler temperature and with fewer emissions. The combustion may be increased by between approximately 10% and approximately 100%, such that the resulting combustion is any increased amount over combustion without using embodiments of the invention to substantially 100% combustion.

Embodiments of the invention may produce a gas mixture from a water electrolysis process, and may deliver the gas mixture to an intake of the internal combustion engine. The gas mixture so generated, as a product of water electrolysis, may be approximately two parts hydrogen to one part oxygen (e.g., approximately 2:1) or that is less than 2:1 hydrogen to oxygen (e.g., in the range of 0.5:1 to 1.75:1, etc.). In some embodiments, some of the hydrogen may be removed or recycled from the gas mixture before it is delivered to the engine. Accordingly, some embodiments may effectively produce a gas mixture that is approximately two parts oxygen to one part hydrogen (e.g., approximately 2:1) or that is less or more than 2:1 oxygen to hydrogen (e.g., in the range of 1:1 to 2.5:1, etc.). In some embodiments, the system may generate and supply a gas mixture which has an oxygen-to-hydrogen ratio of less than 3.5:1.

The volume and/or composition generated of the gas mixture may be reliably controlled to provide a gas mixture for combustion according to engine needs (e.g., engine speed, etc.) so as to maximally enhance combustion. Additionally, the generation of the gas mixture may be reliably controlled to prevent a runaway condition in the gas generation system. The generation of the gas mixture may be adapted to provide for combustion for any desired size of internal combustion engine. The system may produce in the range of approximately 0.08 to 0.75 liters of gas per minute per liter of engine displacement, and may produce, for example, in the range of between approximately one to approximately seven liters of gas per minute.

Embodiments of the invention may alter combustion in the internal combustion engine to reduce particulate formation. In some embodiments, particulate formation may be reduced in a range from at least approximately 5% to approximately 100%. The gas mixture generated by embodiments of the invention may be used as an oxidizer or to increase the concentration of an oxidizer in an internal combustion engine. The gas mixture generated may act as an accelerant to speed combustion, enhance combustion, and/or increase the extent of combustion. A shorter combustion process may be achieved according to embodiments of the invention, which may lower engine temperatures and reduce the formation of nitrogen oxides. The gas mixture generated using embodiments of the invention may supplant a portion of the air delivered to an internal combustion engine.

An exemplary system for improving efficiency of an internal combustion engine includes an electronic controller generating an alternating-current (AC) signal having a frequency in a range between 10 MHz and 50 MHz and comprising a positive output and a negative output and an electrolysis reactor electrically connected to the electronic controller. The electrolysis reactor includes a plurality of substantially parallel plates arranged in a stack. The plurality of plates includes a central positive plate centrally located in the stack and electrically connected to the positive output, a first positive end plate electrically connected to the positive output, and a second positive end plate electrically connected to the positive output. The plurality of plates also includes a first negative plate located in the stack equidistantly between the central positive plate and the first positive end plate and electrically connected to the negative output, and a second negative plate located in the stack equidistantly between the central positive plate and the second positive end plate and electrically connected to the negative output. The plurality of plates further includes a plurality of neutral plates, each neutral plate being disposed between one of the positive plates and one of the negative plates, wherein each of the neutral plates is not electrically connected to either of the positive outlet or the negative outlet by a metallic electric connection. The system also includes an aqueous solution flowing through the electrolysis reactor, the solution containing an electrolyte.

The electrolyte in the solution is generally not consumed by the electrolysis reaction within the electrolysis reactor. Accordingly, while water (e.g., distilled water) will be added to the system from time to time as water is consumed in the electrolysis process, it is anticipated that new electrolyte will only be rarely if ever added to the system after an initial addition of electrolyte. The electrolyte may be any of a variety of electrolytes, such as potassium hydroxide (KOH), sodium hydroxide (NaOH), sodium carbonate ($Na_2CO_3$), sodium bicarbonate ($NaHCO_3$) sodium chloride (NaCl), potassium carbonate ($K_2CO_3$), sulfuric acid ($H2_2SO_4$), or acetic acid ($CH_3COOH$). In certain embodiments, the electrolyte is KOH. A tank may be provided containing the aqueous solution containing the electrolyte. The typical operating state of the tank may be from approximately one-fourth to approximately two-thirds full, or from approximately one third to approximately two-thirds full. The tank may receive an output from the electrolysis reactor at a top of the tank, and a gas space above the surface of the aqueous solution in the tank may permit gas to separate from liquid in the fluid received into the tank from the electrolysis reactor.

The size of the tank may be selected to provide sufficient aqueous solution for a desired application and operation range/time. In certain embodiments, the tank may have a capacity of between approximately two and approximately ten liters, although larger and smaller tanks may be used efficaciously without serious modification to functioning of the system, and the tank may be made larger to accommodate larger systems, larger engines, longer desired operating times, etc. Additionally, multiple tanks may be used in certain embodiments to provide additional capacity and/or to accommodate space issues in proximity to the internal combustion engine with which the system is used.

An electrical connection between the positive output and each of the positive plates may include an electrical wire between the electronic controller and the electrolysis reactor and an electrical connection between the negative output and each of the negative plates may include an electrical wire between the electronic controller and the electrolysis reactor. Electrical wires may extend to each of the positive plates and to each of the negative plates, and the positive and negative plates may include a portion shaped to facilitate connection with an electrical wire or an electrical connector of the electrical wire.

Each plate in the stack may be separated from each immediately adjacent plate in the stack by an incompressible non-conductive spacer. The non-conductive spacer may be formed from an incompressible material, such as one of various plastic materials or compositions. Each spacer may have a border portion extending along an outer edge of its adjacent plates and a central divider extending from one side of the spacer to an opposite side of the spacer. The central divider may divide an inter-plate space between immediately adjacent plates into two fluidly separate elongate chambers.

Each plate except the central positive plate may include four fluid passage holes, with one fluid passage hole being disposed at a first end of each elongate chamber, and with one fluid passage hole being disposed at a second end of each elongate chamber. Accordingly, fluid may flow through the fluid passage holes and along each elongate chamber, but substantially will not pass laterally between elongate chambers between pairs of plates. The central positive plate may be substantially impermeable to passage of fluid. Accordingly, the central positive plate serves to divide the stack into two sets of two fluid paths (the sets of fluid paths on each side of the central positive plate being divided by the central dividers of the non-conductive spacers). A fluid-tight gasket may be disposed around an edge of each elongate chamber between immediately adjacent plates. The fluid-tight gasket may be slightly thicker than the non-conductive spacer in a non-compressed state, but may be compressible.

A plurality of non-conductive fasteners, or fasteners separated from the plates by a non-conductive sleeve may secure the plurality of plates and the non-conductive spacers together in the stack. As the fasteners are tightened, they compress the gaskets until each plate is in contact with its incompressible non-conductive spacer(s), and the stack is thus fully assembled and the elongate chambers are fluid-tight. The non-conductive spacers are substantially identical in thickness, and accordingly the distance between adjacent plates of the plurality of plates is also substantially identical such that when the AC signal is applied to the stack of plates, all of the plates resonate in tandem.

A pump may be fluidically connected to the electrolysis reactor to circulate the aqueous solution through the electrolysis reactor. The pump's output may be divided substantially equally to the four available flow paths (one set of fluid passage holes per each set of elongate chambers. The pump may be of a type having electrical components electrically insulated from the aqueous solution passed through the pump. The pump may have no metal parts in contact with the aqueous solution. The pump may be a diaphragm pump in certain embodiments.

In some embodiments, the AC signal may have a frequency of between 26 and 36 MHz.

In the system, all components of the system exposed to the aqueous solution may be electrically insulated from a vehicle containing the system or from an engine connected to the system, such that the only electrical input to or electrical output from the aqueous solution occurs at the stack of plates where the output of the electronic controller is received. Additionally, because each plate is separated from adjacent plates by the non-conductive spacer, the only electrical connection between plates occurs through the aqueous solution, resulting in the desired electrolysis reaction as the AC signal passes between plates through the aqueous solution.

In some embodiments, the stack of plates includes three positive plates (the central positive plate and the two positive end plates), two negative plates (spaced equally between the central positive plate and each of the two positive end plates), and twenty neutral plates (five neutral plates between each negative plate and each positive plate. Each of the plates may be formed of stainless steel. In some embodiments, the stainless steel is 316L stainless steel. The major surfaces of the plates may be scored or abraded (such as using a heavy-duty belt sander), which forms minute antennas on the major surfaces of the plates to facilitate the transmission of the AC signal between adjacent plates through the aqueous solution between adjacent plates. The scoring or abrading of the plate major surfaces may be done at an angle along the plates so as to encourage mixing of the fluid passing between adjacent plates in the elongate chambers.

Another exemplary system for improving efficiency of an internal combustion engine includes an electronic controller generating an AC signal having a frequency in a range between 26 MHz and 36 MHz and comprising a positive output and a negative output and an electrolysis reactor electrically connected to the electronic controller. The electrolysis reactor includes a plurality of substantially parallel plates arranged in a stack. The plurality of plates includes a central positive plate centrally located in the stack and electrically connected to the positive output, a first positive end plate electrically connected to the positive output, and a second positive end plate electrically connected to the positive output. The plurality of plates also includes a first negative plate located in the stack equidistantly between the central positive plate and the first positive end plate and electrically connected to the negative output and a second negative plate located in the stack equidistantly between the central positive plate and the second positive end plate and electrically connected to the negative output. The plurality of plates further includes a plurality of neutral plates, each neutral plate being disposed between one of the positive plates and one of the negative plates, wherein each of the neutral plates is not electrically connected to either of the positive outlet or the negative outlet by a metallic electric connection. The electrolysis reactor also includes a plurality of incompressible non-conductive spacers, with one non-conductive spacer disposed between each pair of immediately adjacent plates. Each spacer includes a border portion extending along an outer edge of its adjacent plates and a central divider extending from one side of the spacer to an opposite side of the spacer and dividing an inter-plate space between immediately adjacent plates into two fluidly separate elongate chambers. The system further includes an aqueous solution flowing through the electrolysis reactor, the aqueous solution including an electrolyte.

The plurality of plates may have any desirable shape, and the positive and negative plates may include portions adapted to permit connection between the positive and negative plates and the electronic controller. In some embodiments, the plurality of plates all have a similar or identical thickness. In alternate embodiments, the plurality of neutral plates all have a similar or identical thickness, and the thickness of the positive and/or negative plates may vary from the thickness of the neutral plates. The plurality of plates arranged in the stack may be disposed between a pair of non-conductive end plates. The end plates and the stack may be secured into the electrolysis reactor by a plurality of electrically non-conductive bolts and/or bolts separated from the plurality of plates by a non-conductive sleeve or other non-conductive element.

A fluid-tight compressible gasket may be disposed around an edge of each elongate chamber between immediately adjacent plates. Accordingly, the compressible gaskets may run along edges of the incompressible spacer.

Each plate except the central positive plate may include four fluid passage holes, with one fluid passage hole being disposed at a first end of each elongate chamber, and with one fluid passage hole being disposed at a second end of each elongate chamber, and wherein the central positive plate is substantially impermeable to passage of fluid from any elongate chamber. A diaphragm pump may be fluidically connected to the fluid passage holes of the first positive end plate and the second positive plate, whereby the diaphragm pump circulates the aqueous solution through four sub-cells of the electrolysis reactor, beginning and ending for two sub-cells with the fluid passage holes of the first positive end plate and beginning and ending for two other sub-cells with the fluid passage holes of the second positive end plate.

The system may also include a tank storing a quantity of the aqueous solution and having a gaseous space above a liquid level in the tank. The system may further include a supply fluid circulation path between a lower end of the tank and the electrolysis reactor, a return fluid circulation path between the electrolysis reactor and an upper end the tank, and an engine supply line extending from the gaseous space of the tank to an engine inlet of an internal combustion engine, the engine supply line including a scrubber to remove liquid from a fluid flowing to the engine inlet from the tank.

The tank may be in close proximity to and vertically spaced above the electrolysis reactor, and the tank may be in close proximity to the internal combustion engine.

An exemplary method for improving efficiency of an internal combustion engine includes a step of providing an electrolysis reactor in close proximity to an internal combustion engine. The electrolysis reactor includes a plurality of substantially parallel plates arranged in a stack. The plurality of plates includes a central positive plate centrally located in the stack and electrically connected to the positive output, a first positive end plate electrically connected to the positive output, and a second positive end plate electrically connected to the positive output. The plurality of plates also includes a first negative plate located in the stack equidistantly between the central positive plate and the first positive end plate and electrically connected to the negative output and a second negative plate located in the stack equidistantly between the central positive plate and the second positive end plate and electrically connected to the negative output. The plurality of plates further includes a plurality of neutral plates, each neutral plate being disposed between one of the positive plates and one of the negative plates, wherein each of the neutral plates is not electrically connected to either of the positive outlet or the negative outlet by a metallic electric connection. The electrolysis reactor further includes a plurality of incompressible non-conductive spacers, with one non-conductive spacer disposed between each pair of immediately adjacent plates. Each spacer includes a border portion extending along an outer edge of its adjacent plates and a central divider extending from one side of the spacer to an opposite side of the spacer and dividing an inter-plate space between immediately adjacent plates into two fluidly separate elongate chambers. The method further includes a step of supplying an AC signal having a frequency in a range between 26 MHz and 36 MHz between the various positive and the various negative plates. The method also includes steps of flowing an aqueous solution including an electrolyte through the electrolysis reactor, whereby a water electrolysis product is formed in the solution and delivering the water electrolysis product to an intake of the internal combustion engine.

The method may include a step of controlling an amperage of the AC signal to prevent heat runaway of the aqueous solution.

Figure 2:
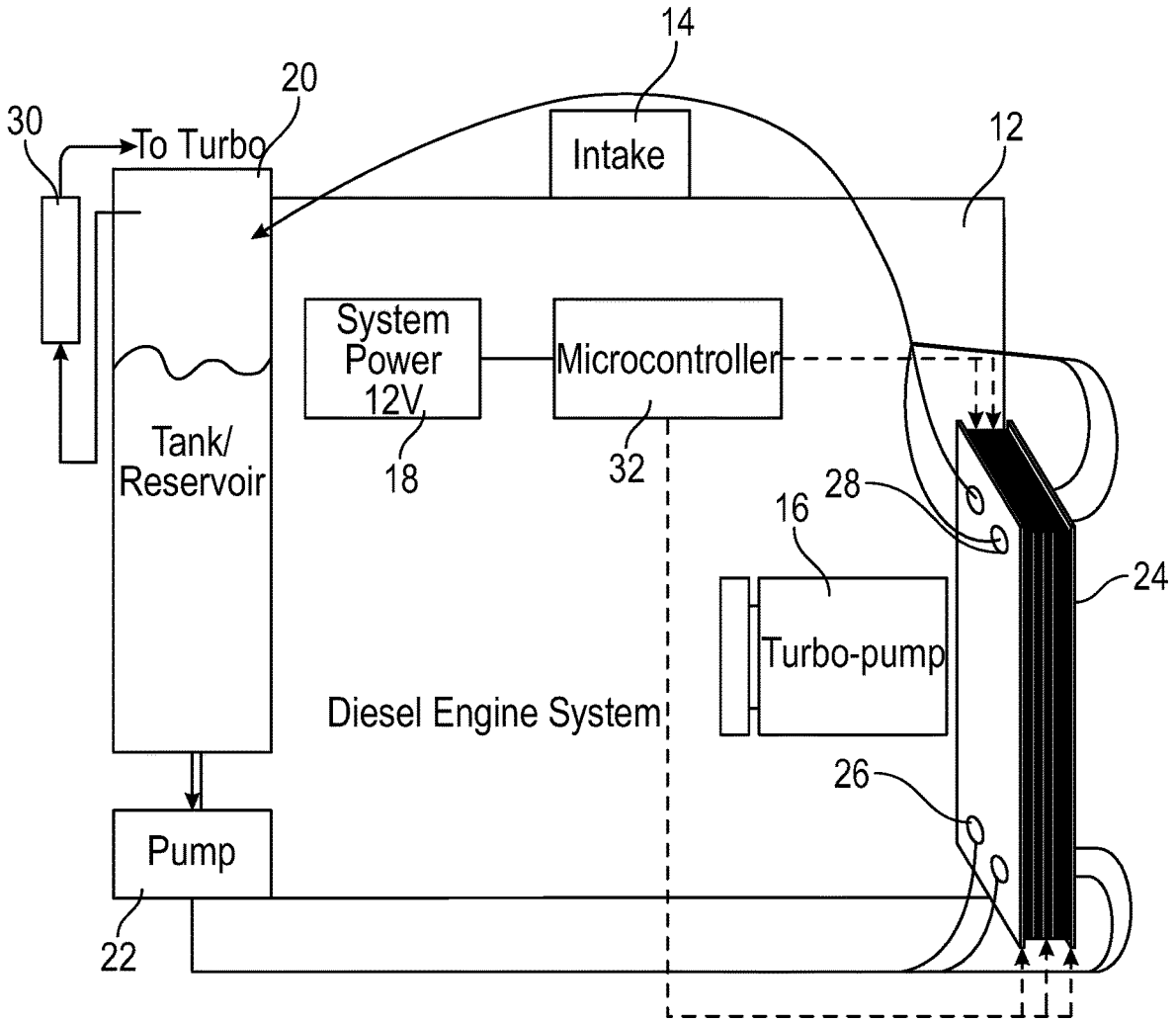
FIG. 2 shows a diagrammatic view of an exemplary engine system and accompanying system to increase efficiency of the engine.

FIG. 1 illustrates an exemplary environment in which systems and methods in accordance with embodiments of the invention may be utilized. FIG. 1 shows a representative vehicle 10 having an internal combustion engine 12. By way of example, the vehicle 10 may be a commercial truck and the internal combustion engine 12 may be a diesel engine. The internal combustion engine 12 may have various standard components, such as an air intake 14, a turbo-pump 16, and a battery 18 or other system power source. The internal combustion engine 12 is generally or largely contained within an engine compartment of the vehicle 10, as is known in the art. The engine compartment also houses various components of an exemplary system for improving the efficiency of the internal combustion engine 12. FIG. 2 illustrates the internal combustion engine 12 and the accompanying system for improving the efficiency of the internal combustion engine 12 in more detail. The internal combustion engine 12 is in most essential respects a standard engine with only slight modifications to accommodate the system to improve efficiency, accordingly, the internal combustion engine 12 and some of its components are represented in schematic block form.

It has been found that it is important to minimize the distance between the components of the system for improving the efficiency of the internal combustion engine 12 to maximize the effectiveness of the system. Accordingly, it is advantageous to locate most or all of the components of the system within the engine compartment and in close physical proximity to the internal combustion engine. As most of the individual components of the system may be of modest size and may be connected to other components of the system via one or more hoses and wires, it is generally possible to locate the various components of the system for improving the efficiency of the internal combustion engine 12 within available unused spaces within the engine compartment. If, however, such spaces are not available within a particular engine compartment, it may be necessary to modify one or more body panels defining the engine compartment to create sufficient space for one or more components of the system. Alternatively, one or more components of the system may be located outside the engine compartment but connected via one or more hoses and/or wires passing from the engine compartment to such component(s).

In the illustrative system of FIG. 2, a reservoir or tank 20 serves to store an aqueous solution of substantially pure (e.g., distilled) water and an electrolyte or conductant such as KOH. The water is consumed in the electrolysis reaction, and the electrolyte serves to facilitate the reaction but is not consumed by the reaction. Accordingly, it is generally unnecessary to add additional electrolyte and only water is added to the system as it is consumed by the electrolysis reaction. By way of example, a system installed in a 1990 GMC box truck uses approximately one cup (approximately 240 ml) of distilled water per five hundred miles driven.

The tank 20 contains the aqueous solution as well as an air space above the aqueous solution. The air space above the aqueous solution serves as a volume in which gases returning to the tank (the products of the electrolysis reaction) can separate from remaining liquid as they fall into the tank 20. Accordingly, the tank 20 should not be over-filled, but remains no more than approximately three-fourths full. It should be understood, however, that if the tank geometry is varied to provide an air space in which returning liquid can be separated from returning gasses while being filled more than three-fourths full, that such an embodiment is embraced for use with embodiments of the invention.

In general, the tank 20 will also not be allowed to be less than approximately one-third full, as when the volume of aqueous solution in the tank falls, the concentration of electrolyte such as KOH rises. If the level of the tank 20 falls too much, there is a risk of precipitation of the electrolyte and/or gumming of the system. Accordingly, the system is monitored and distilled water or other substantially pure water is added to the system from time to time to keep the level of water within the tank 20 generally within the range of between approximately one-third and approximately three-fourths full.

The tank 20 may be of any desired size that satisfies the demands of the internal combustion engine 12 and the intended use of the system. Given the example above of a system that consumes approximately one cup (approximately 240 ml) of liquid per 500 miles, the tank 20 for such system could be as small as approximately one quart (approximately 1 liter) if the user is willing to fill the tank 20 regularly during use of the system. Alternatively, the need to fill the tank 20 can be reduced by increasing the size of the tank 20 to increase the available range of the system between refills of water. By way of example only, a tank 20 of approximately five quarts' volume provides a good balance of modest size to fit within the engine compartment without requiring constant monitoring of the level of the aqueous solution.

The tank 20 has an outlet disposed near the bottom of the tank 20, such that the outlet remains covered with aqueous solution even as the level of solution in the tank 20 falls and/or as driving the vehicle 10 causes the solution in the tank 20 to slosh around. The outlet of the tank 20 is operative connected to a pump 22, such as by a hose or tube extending from the tank 20 to the pump 22. Because the aqueous medium contains an electrolyte and is generally conductive to electricity, and because the system includes a source of AC current to cause electrolysis, there is electricity or an electrical charge in the aqueous medium passing through the pump 22. Accordingly, it is necessary for the portions of the pump 22 in contact with the aqueous solution to be electrically isolated from the operative electrical portions of the pump 22 to prevent the electricity or electrical charge from flowing into and burning out the pump 22. Accordingly, the pump 22 may be a diaphragm pump that only has non-conductive (e.g., non-metallic) components in contact with the aqueous medium. While other electrically insulated or isolated pump types may be used, such as magnetically coupled pumps, a diaphragm pump has been found to be most reliable for use with the system.

The pump 22 is operatively connected to an electrolysis reactor 24 or reactor, such as by one or more hoses or tubes extending between the pump 22 and the electrolysis reactor 24. The electrolysis reactor 24 in the illustrated example includes four inlets 26, and the output of the pump 22 is accordingly split into four flow paths to supply aqueous medium to each of the four inlets 26. It is desirable for the electrolysis reactor 24 to be located within the engine block (or at another location in general proximity of the internal combustion engine) at a physical position that is well below the actual or anticipated level of liquid in the tank 20. This ensures that gravity will assist in keeping the electrolysis reactor 24 filled with the aqueous medium from the tank 20 even if the pump 22 is not operating. Accordingly, the tank 20 may be mounted at a position relatively high in the engine compartment, while the electrolysis reactor 24 may be mounted at a position relatively low in the engine compartment.

The inlets 26 of the electrolysis reactor are located toward the bottom of the electrolysis reactor 24. Two inlets 26 are located on each major surface of the electrolysis reactor 24. The electrolysis reactor also includes four outlets 28 located toward the top of the electrolysis reactor 24. Each outlet 28 is fluidically connected within the electrolysis reactor 24 to the inlet 26 directly below that outlet 28, as will be discussed in more detail below. Within the electrolysis reactor 24, there is substantially no flow of aqueous medium between the individual inlets 26. Aqueous medium flowing into one inlet 26 will flow through the electrolysis reactor 24 upward to the outlet 28 directly above the inlet 26 without passing to any of the other outlets 28.

The outlets 28 are operatively connected to an inlet of the tank 20, such as by one or more hoses or tubes. The inlet of the tank is disposed at or near a top of the tank 20, above an upper surface of the aqueous medium within the tank, such that any materials (liquids and gases) Oreturning to the tank 20 from the outlets 28 of the electrolysis reactor 24 enter the tank 20 within the air space, such that a liquid component (distilled water and electrolyte such as KOH) of the returning materials falls back into the aqueous medium of the tank 20, while a gaseous component of the returning materials separates from the liquid component and blends with the air or other gas in the air space. Another outlet from the tank 20 that is disposed in the air space is operatively connected (e.g., via a hose or tube) to a scrubber 30 that serves to remove residual moisture from gas passing through the scrubber 30. The scrubber 30 may contain a plurality of fibers of any suitable material (e.g., plastic fibers) that facilitate condensation of any remaining liquid from the flow of gas leaving the tank 20. The output of the scrubber 30 is then passed to the internal combustion engine 12, such as by being delivered to a Venturi tube within the intake of the turbo pump 16. The scrubber 30 may have a return line to return any condensed liquid back to the tank 20.

The tank 20 and the electrolysis reactor 24 form a closed-loop system that circulates the aqueous medium from the tank 20, through the pump 22 to the electrolysis reactor 24, and back to the tank 20. In the process, the electrolysis reactor 24 generates gaseous products from the water in the aqueous medium, which gaseous products are returned to the tank 20 with the remaining aqueous medium. The gaseous products in the tank 20 are then passed from the tank 20 to the internal combustion engine 12, where they are used to improve the efficiency and/or performance of the engine 12, improve the quality or extent of the burn of fuel by the engine 12, and/or reduce particulate emissions of the engine 12.

The system for improving efficiency of the internal combustion engine 12 includes an electronic controller or microcontroller 32 that is powered by the battery 18 of the vehicle 10, or alternatively by a separate battery or power source. In one embodiment, the microcontroller 32 generates an AC signal having a frequency of between approximately 10 MHz and approximately 50 MHz. In an alternate embodiment, the microcontroller 32 generates an AC signal having a frequency of between approximately 15 MHz and approximately 45 MHz. In another embodiment, the microcontroller 32 generates an AC signal having a frequency of between approximately 20 MHz and approximately 40 MHz. In an alternate embodiment, the microcontroller 32 generates an AC signal having a frequency of between approximately 26 MHz and approximately 36 MHz. The voltage of the AC signal may vary from embodiment to embodiment, but may range up to approximately the voltage of the battery 18 of the vehicle 10, or, for example, approximately twelve volts.

The microcontroller 32 may select the frequency and/or voltage of the AC signal, in part, on a measured response of the electrolysis reactor 24 and/or the performance of the internal combustion engine 12, so as to appropriately achieve a maximum performance of the internal combustion engine 12, to achieve a maximum reduction in particulate output of the internal combustion engine 12, to maximize efficiency of the internal combustion engine 12, to maximize combustion of fuel in the internal combustion engine 12, and the like. The microcontroller 32 may also be configured to ensure safe and controlled operation of the electrolysis process in the electrolysis reactor 24. For example, as the electrolysis process proceeds, the temperature of the aqueous solution may increase. The increase in temperature of the aqueous solution may increase conductivity of the aqueous solution. The increase in conductivity of the aqueous solution may further lead to increased electrolysis within the electrolysis reactor 24. The increased electrolysis may then lead to increased temperatures within the aqueous solution. As may be appreciated, if this process is left uncontrolled, the aqueous solution may eventually runaway due to positive feedback, resulting in boiling of the aqueous solution and/or damage to the system. The microcontroller 32 may be programmed to detect and prevent a runaway heating condition within the system.

The microcontroller 32 may be operatively connected to a variety of sensors and/or switches to permit the microcontroller 32 to control the process performed by the system. For example, the microcontroller 32 may be operatively connected to one or more sensors measuring one or more performance metrics of the internal combustion engine 12, such as exhaust characteristics, temperature of the engine 12, etc. Additionally, the microcontroller 32 may be operatively connected to one or more sensors measuring the temperature of the aqueous solution in the system, such as in the tank 20, at the pump 22, within the electrolysis reactor 24, and/or within any line (e.g. hose or tube) connecting any of these system elements. The microcontroller 32 may be operatively connected to one or more sensors measuring the gaseous output of the system to ensure that a desired gas concentration is delivered to the internal combustion engine 12. The microcontroller 32 may be operatively connected to one or more moisture sensors or switches within the feed lines between the tank 20 and the internal combustion engine 12, so as to be able to disable the system before undue amounts of moisture are delivered to the engine 12, such as upon failure or overload of the scrubber 30 or similar events. The microcontroller may also or alternately be operatively connected to one or more safety switches adapted to signal conditions such as over-full conditions or under-full conditions in the tank 20 to prevent operation of the system when too much or too little aqueous solution is available for use in the system.

Figure 11:
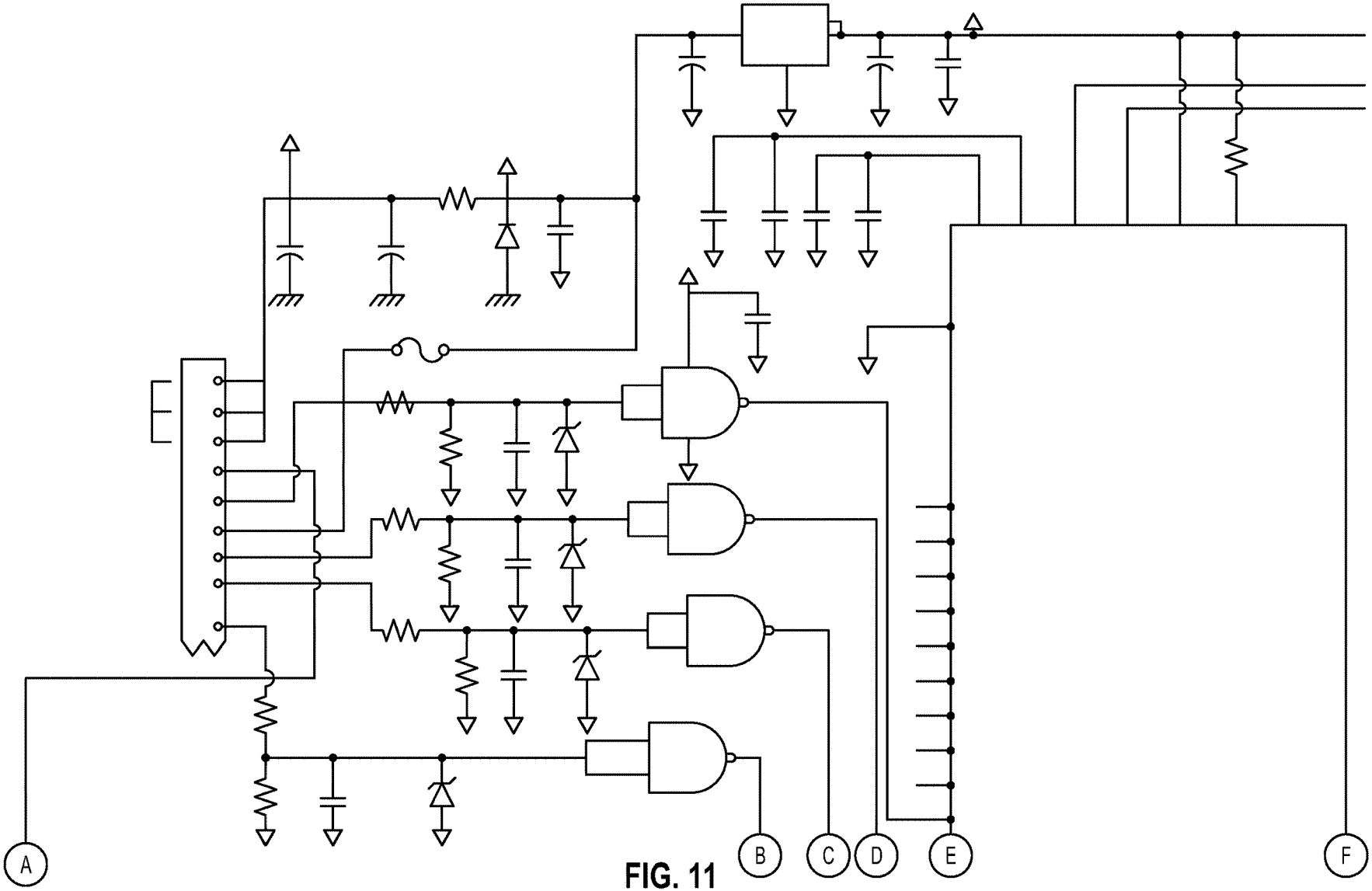
FIG. 11 shows a first portion of a schematic of a microcontroller for use with embodiments of the invention.
Figure 11:
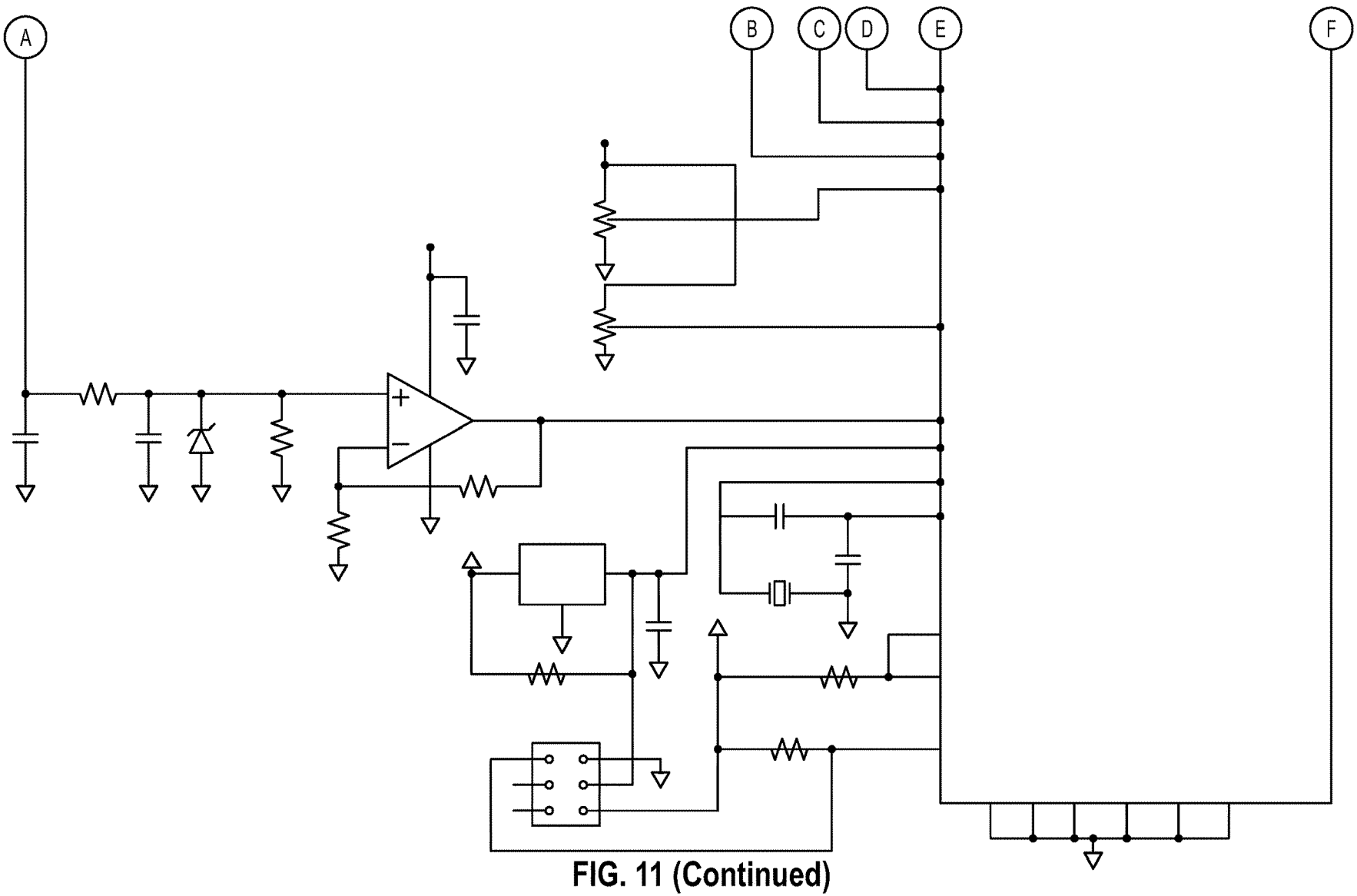
Figure 12:
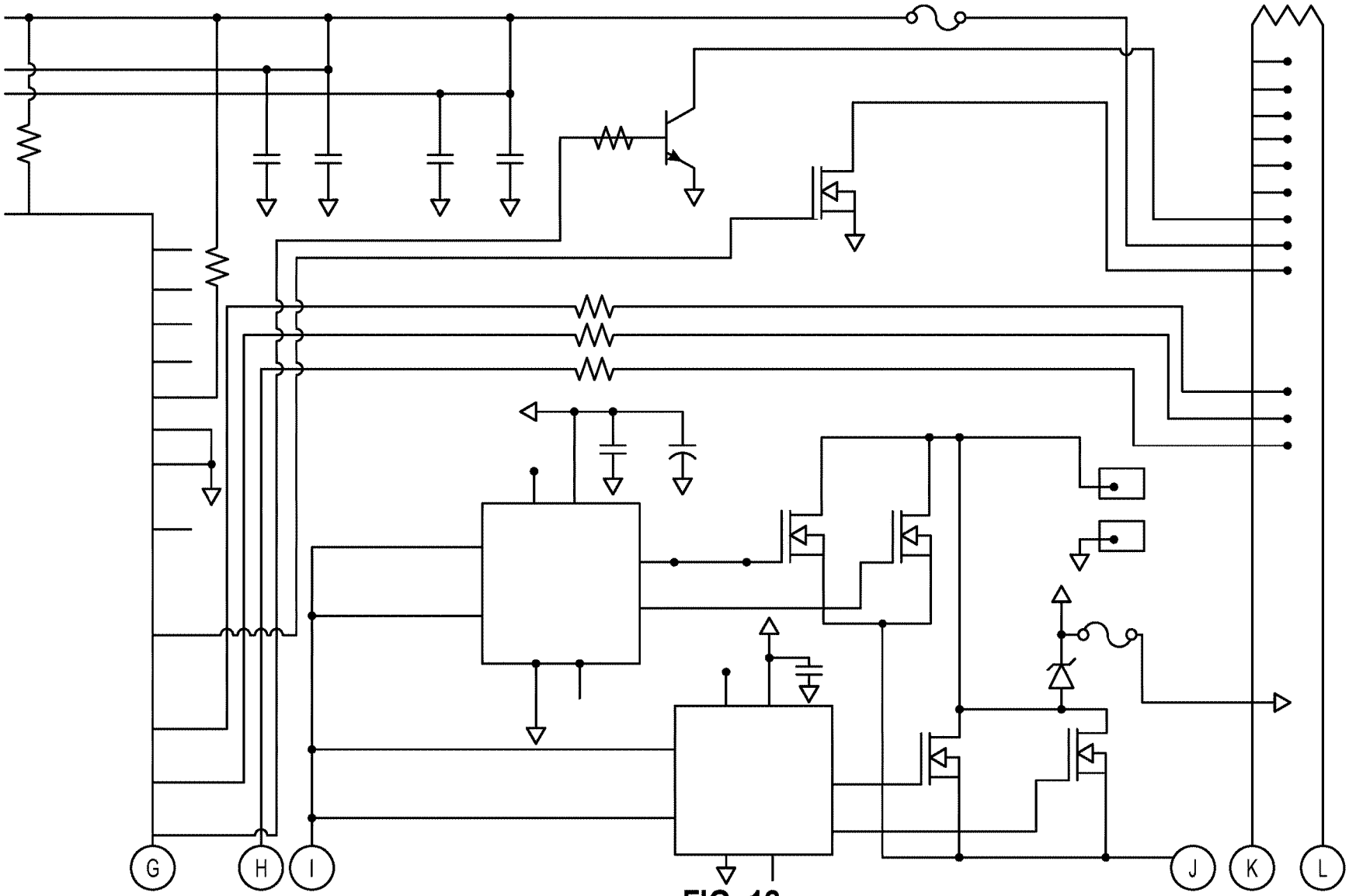
FIG. 12 shows a second portion of the schematic of the microcontroller for use with embodiments of the invention.
Figure 12:
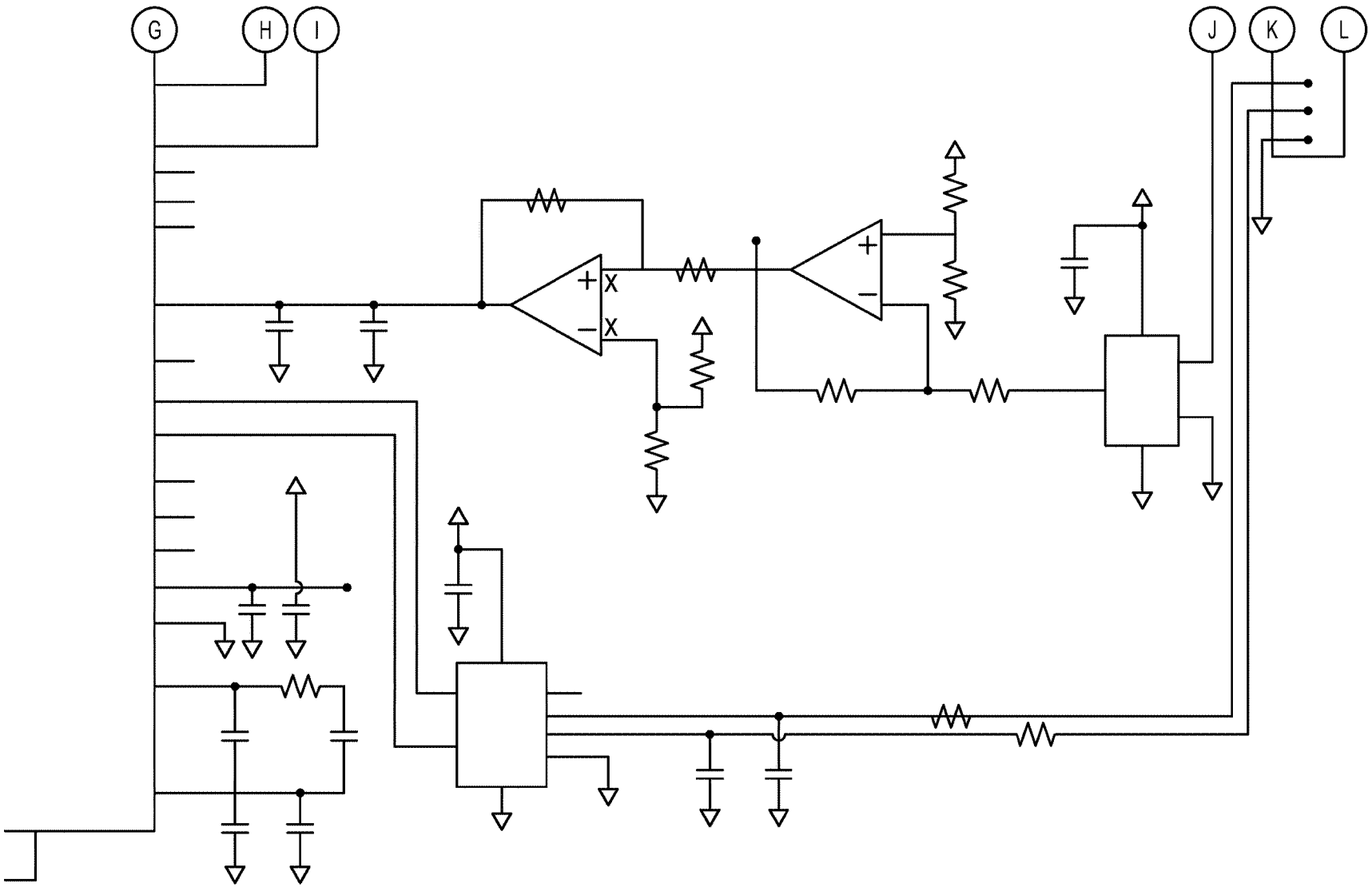

While the microcontroller 32 may take any of a variety of forms, FIGS. 11 and 12 provide a schematic diagram of one embodiment of the microcontroller 32. It should be understood that the provided schematic diagram is intended solely to be illustrative of one embodiment, and that alternate implementations or embodiments of the microcontroller 32 may be provided. The microcontroller 32 operates on twelve volts DC power supplied, for example, by the vehicle battery 18 or power system. The microcontroller measures the engine load and delivers a radiofrequency AC signal to the electrolysis reactor 24 at an appropriate frequency to generate a hydrogen and oxygen gas mixture at the electrolysis reactor 24, which gas mixture can then be separated from the aqueous solution and delivered to the internal combustion engine 12 to achieve a more complete or substantially complete burn of fuel in the cylinders of the internal combustion engine 12. This eliminates or greatly reduces emissions, which are caused by the engine's inability to achieve complete combustion in the chamber. The delivery of oxygen-rich plasma to the cylinder increases the speed of the flame front, achieving a complete burn. Since the entire amount of fuel (e.g. diesel fuel) injected into the combustion chamber is consumed, a greater percentage of the available energy in the fuel is extracted by the internal combustion engine 12, resulting not only in decreased emissions, but in greater efficiency and performance as well as decreased fuel consumption. The decreased burn time also results in decreased engine temperatures and reduced engine wear. The mileage and horsepower of the internal combustion engine 12 are effectively increased.

Figure 3:
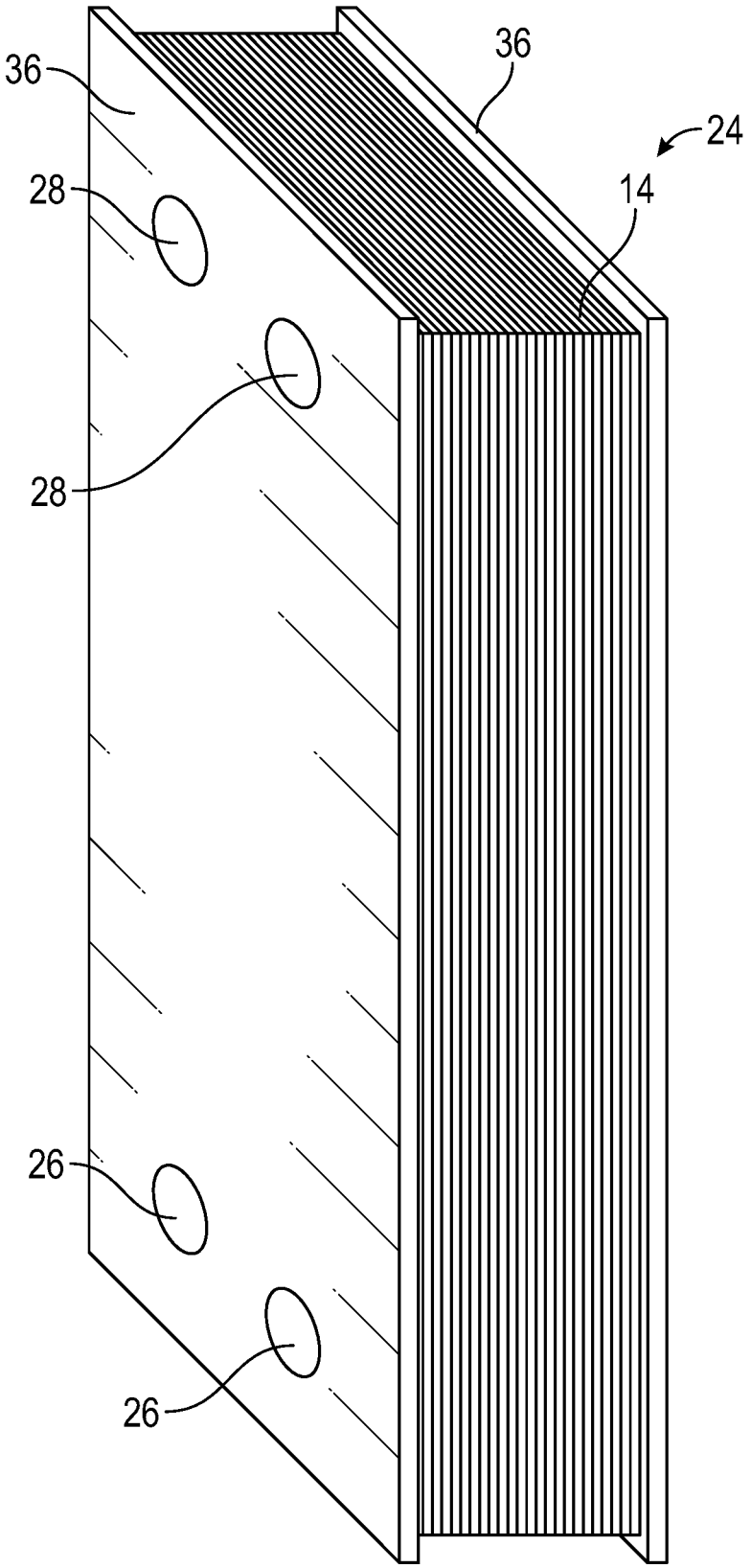
FIG. 3 shows a perspective view of one embodiment of an electrolysis reactor.

FIG. 3 illustrates an enlarged perspective view of an illustrative electrolysis reactor 24 for use with embodiments of the system. The reactor 24 includes a stack 34 of plates located between a pair of non-conductive end plates 36. The end plates 36 define the inlets 26 and the outlets 28 for the electrolysis reactor 24, with two inlets 26 disposed toward a lower end of each side of the electrolysis reactor 24 and two outlets 28 disposed toward an upper end of each side of the electrolysis reactor 24. The end plates 36 may include or be attached to connectors (not shown in FIG. 3) that permit connection of a line (e.g., a hose or tube) to each of the inlets 26 and outlets 28, such as barb connectors and the like. The inlets 26 and outlets 28 may have any desirable shape, including round, oblong, rectangular, and the like. The end plates 36 may be formed of any desirable non-conductive material, such as a variety of plastics and the like.

Figure 4:
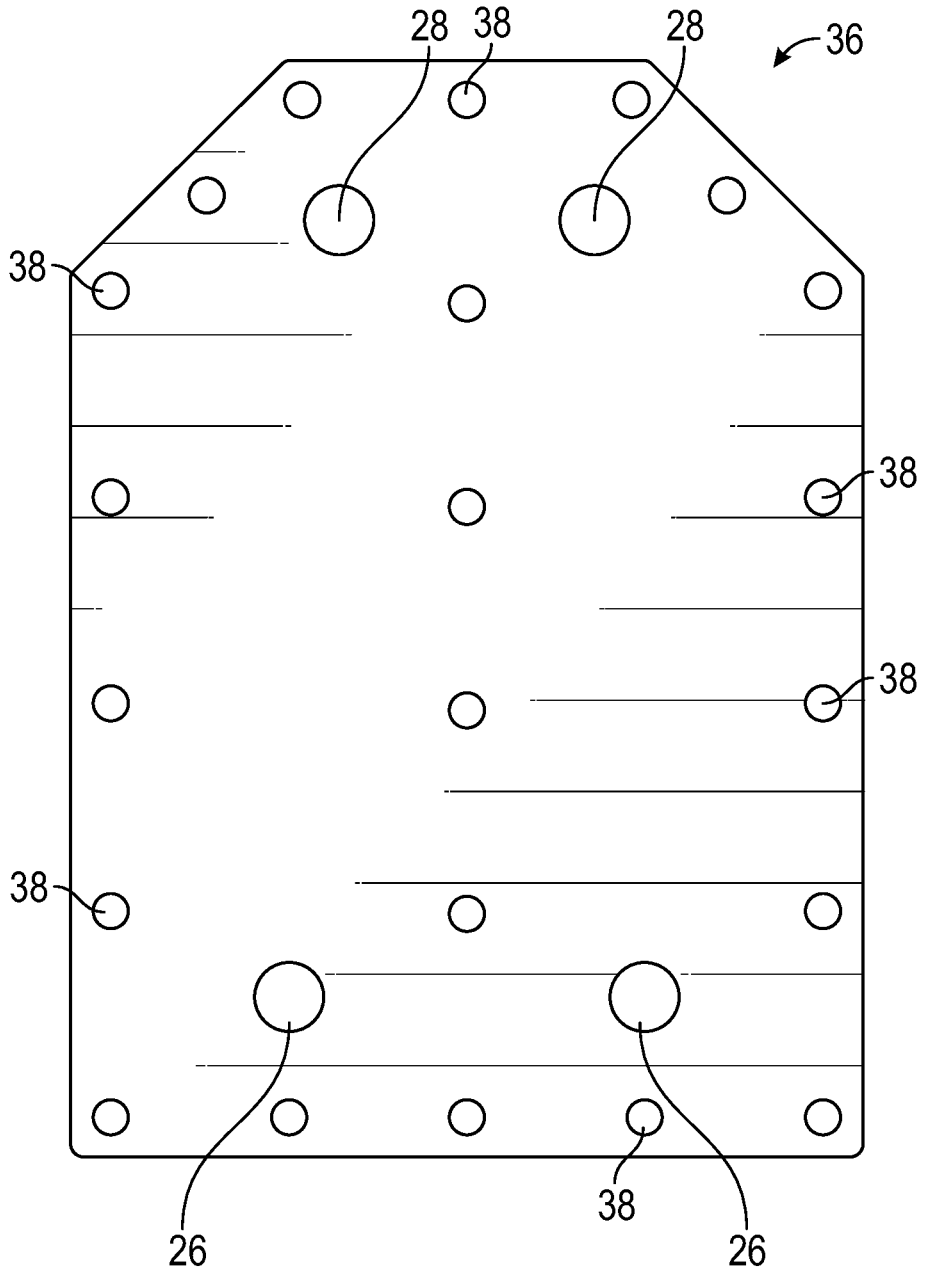
FIG. 4 shows a plan view of a non-conductive end plate of a stack of an electrolysis reactor.

FIG. 4 illustrates an example of one embodiment of the end plates 36. The end plate 36 shown in FIG. 4 includes two inlets 26 and two outlets 28, as discussed above. Additionally, the end plate 36 includes a plurality of fastener through holes 38 adapted to receive fasteners (e.g., bolts) there through to permit assembly of the stack 34 and securing of the stack 34 in its final form. The fasteners are either non-conductive or are received in a non-conductive sleeve passing through the fastener through holes 38 or the like. As may be seen in FIG. 4, there are fastener through holes 38 around the perimeter of the end plate 36, as well as bisecting the end plate 36 along its long axis. The placement of the fastener through holes 38 effectively surrounds two elongate chambers within the stack 34, extending, within the stack, between the inlet 26 and the outlet 28 on each side of the center line of fastener through holes 38.

As may be noted in FIG. 4, the end plate 36 is generally rectangular in shape. In addition, the upper corners of the end plate 36 are truncated. The truncated shape of this embodiment permits a plate within the stack 34, particularly negative and positive plates, to extend beyond the truncated corner of the end plate 36 and of other plates in the stack 34 to facilitate connection with a wire or other connecting element electrically connected to the microcontroller 32. In this way, electrical connections can be made without having connecting elements extending beyond the generally rectangular cuboid shape of the electrolysis reactor 24. It should be understood, however, that other embodiments of the electrolysis reactor 24 and stack 34 may lack the truncated corners shown in FIG. 4 and may instead have elements protruding beyond what is otherwise a boundary of the electrolysis reactor 24 and/or stack 34. The end plates 36 may have any desired thickness. In one embodiment, the end plates 36 are approximately 0.75 inches thick.

Figure 5:
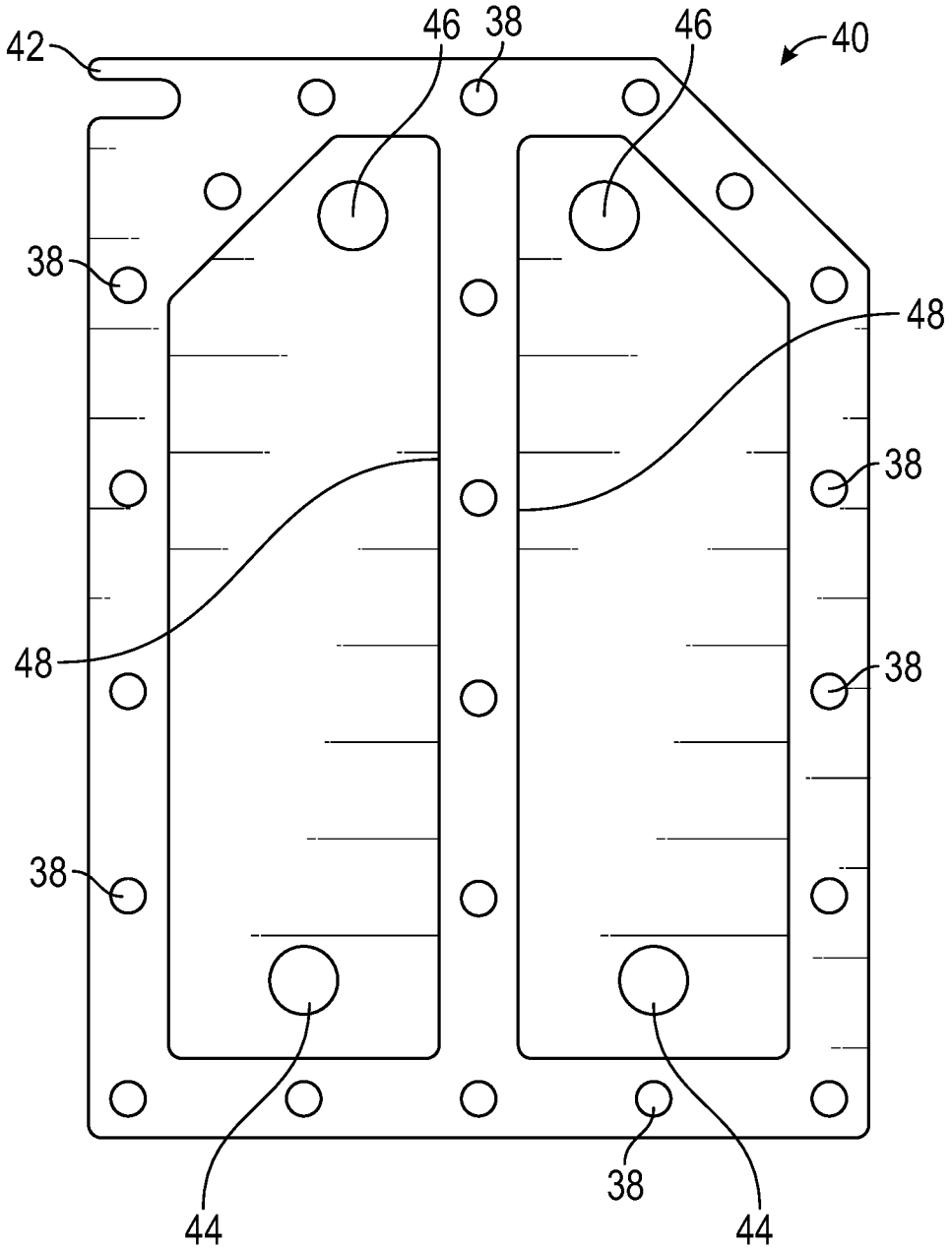
FIG. 5 shows a plan view of a first charged plate for use in a stack of an electrolysis reactor.

FIG. 5 illustrates one embodiment of a first charged plate 40. The first charged plate 40 may serve as either a negative plate or a positive plate in the stack 34. The first charged plate 40 includes an electrical connection tab 42 that is adapted to facilitate making an electrical connection with a wire or other electrical lead operatively connected to the microcontroller 32. By way of example, a removable (e.g., slide-on) electrical connector (not shown) may be used to connect to the electrical connection tab 42. Alternatively, a wire may be soldered or welded to the electrical connection tab 42, either after assembly of the stack 34 or even prior to assembly of the stack 34. The electrical connection tab 42 may extend into the region of the truncated corner of the end plate 34, which may facilitate ease in accessing and/or connecting to the electrical connection tab 42. In some embodiments, the first charged plate 40 may be oriented in a particular orientation depending on whether the first charged plate 40 is being used as a positive plate or a negative plate in the stack 34. For example, if the first charged plate 40 is being used as a positive plate, it may be oriented as shown in FIG. 5 with the electrical connection tab 42 oriented to the upper left. In contrast, if the first charged plate 40 is being used as a negative plate, it may oriented with the electrical connection tab 42 oriented to the upper right (flipped with respect to the view of FIG. 5). The front and back views of the first charged plate 40 are identical, but flipped.

As the first charged plate 40 is adapted to be electrically connected to the microcontroller 32 and to receive the AC electrical signal therefrom, it is formed from an electrically conductive material, specifically a metal. In certain embodiments, the first charged plate 40 is formed from stainless steel. In certain embodiments, the stainless steel is 316L stainless steel. The first charged plate includes a plurality of fastener through holes 38 corresponding to the fastener through holes 38 of the end plate 36, facilitating assembly of the stack 34.

The first charged plate 40 also includes flow holes permitting the passage of aqueous medium through the first charged plate 40. The flow holes include inlet flow holes 44 and outlet flow holes 46. The inlet flow holes 44 are placed in the first charged plate 40 so as to be substantially aligned with the inlets 26 of the end plate 36. Additionally, the outlet flow holes 46 are placed in the first charged plate 40 so as to be substantially aligned with the outlets 28 of the end plate 36. This alignment facilitates the movement of aqueous medium from the inlets 26 to various inter-plate elongate chambers, as will be discussed in more detail below.

Only a portion of the first charged plate 40 will be in contact with the aqueous medium flowing through the electrolysis reactor 24. The portion of the first charged plate 40 that will be in contact with the aqueous medium is illustrated in FIG. 5 by a pair of elongate chamber boundaries 48. The elongate chamber boundaries 48 may or may not represent a physical difference on the surface of the first charged plate 40. By way of example, the first charged plate 40 may be formed to have an elevated surface within the elongate chamber boundaries 48. By way of another example, the first charged plate 40 may be formed to have a recessed surface within the elongate chamber boundaries 48. In still another example, there is essentially no difference in the surface of the first charged plate 40 on either side of the elongate chamber boundaries 48.

While not shown in FIG. 5, the major surfaces of the first charged plate 40 may have a surface treatment that scores or abrades at least a portion of the major surfaces that is designed to be in contact with the aqueous medium. Alternatively, the first charged plate 40 may have been formed using a process that created an abraded or scored surface of at least a portion of the major surfaces of the first charged plate 40. The portion of the major surfaces that is scored or abraded is at least the portion generally falling within the elongate chamber boundaries 48. In some embodiments, the entire major surfaces of the first charged plate 40 are scored or abraded, not just the portion falling within the elongate chamber boundaries 48. The scoring or abrading in certain embodiments is done on an angle relative to the sides and bottom of the first charged plate 40 (as depicted in FIG. 5). In alternate embodiments, the scoring or abrading is done substantially parallel to the bottom of the first charged plate 40 (as depicted in FIG. 5). The scoring or abrading serves several purposes. First, the scoring or abrading facilitates the transmission of electrical energy from the first charged plate 40 to the adjacent aqueous medium. Second, the scoring or abrading imparts some modification in the flow of aqueous medium through the elongate chambers between adjacent plates in the stack 34. The abrading or scoring may impart eddies in the aqueous medium, may resist flow of the aqueous medium to some extent such that flow of the aqueous medium is more evenly distributed to all elongate chambers in the stack 34, or may otherwise modify the distribution of flow aqueous medium in the stack 34. The scoring or abrading may be formed using a heavy-duty belt sander or the equivalent.

Figure 6:
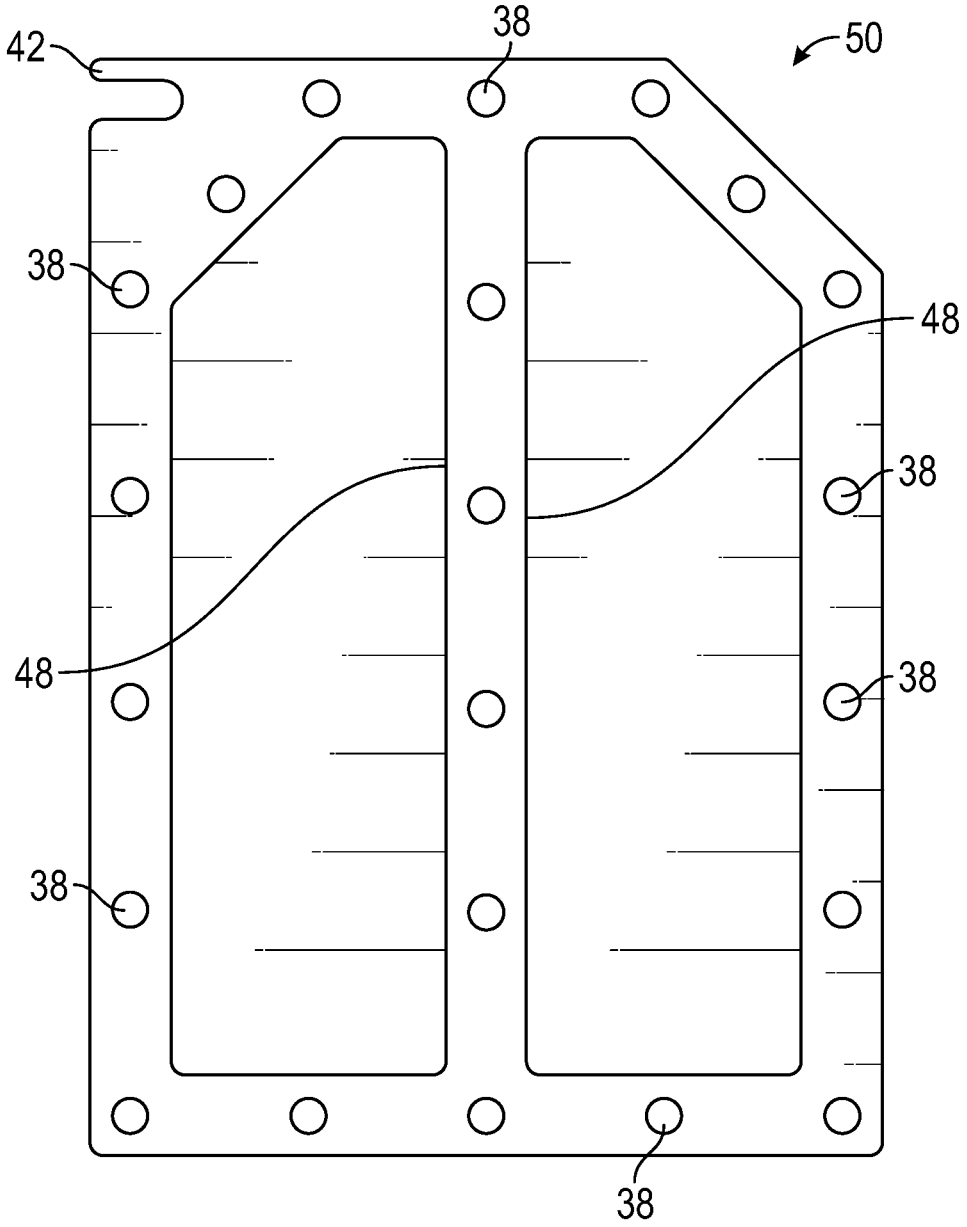
FIG. 6 shows a plan view of a second charged plate for use in a stack of an electrolysis reactor.

FIG. 6 shows one embodiment of a second charged plate 50. The second charged plate 50 is adapted to be centrally located in the stack 34. It may be noted that while the second charged plate 50 includes the fastener through holes 38 similar to those of the end plate 36 and the first charged plate 40, the second charged plate 50 does not include the inlet flow holes 44 or the outlet flow holes 46. Accordingly, the second charged plate 50 is substantially impermeable to the passage of the aqueous medium when the stack 34 is fully assembled. The second charged plate 50 serves to divide the stack 34 into two front-and-back halves. Since each inter-plate space is also divided into two elongate chambers as discussed above and in further detail below, the electrolysis reactor 24 effectively includes four separate mini reactors: two between the second charged plate 50 and one end plate 36 and two between the second charged plate and the other end plate 36. Each mini reactor is substantially fluidically separate from each of the other mini reactors.

The second charged plate 50 may be abraded or scored in a fashion similar to the first charged plate 40. Additionally, as the second charged plate 50 still contacts the aqueous medium, it has a portion of its surface defined by elongate chamber boundaries 48 as does the first charged plate 40. The elongate chamber boundaries 48 may represent borders of elevated or recessed portions of the major surfaces of the second charged plate 50, or there may be essentially no difference in the surface of the second charged plate 50 on either side of the elongate chamber boundaries 48. The second charged plate 50 may be formed of a material similar to or identical to the material of the first charged plate 40, e.g., 316L stainless steel or the like. As with the first charged plate 40, the second charged plate 50 may include the electrical connection tab 42 to facilitate an electrical connection to the microcontroller 32.

Figure 7:
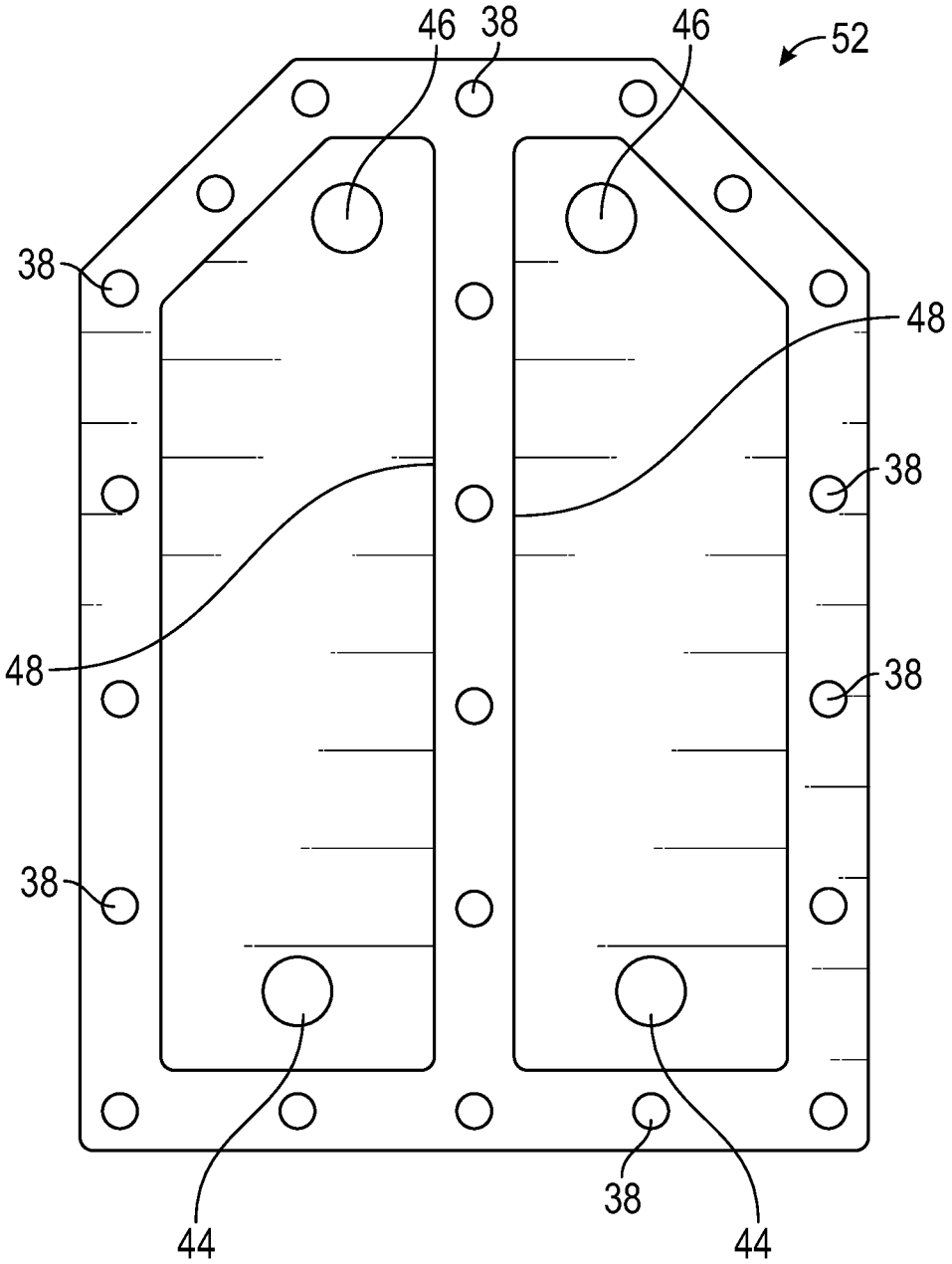
FIG. 7 shows a plan view of a neutral plate for use in a stack of an electrolysis reactor.

FIG. 7 shows one embodiment of a neutral plate 52. The neutral plate 52 lacks the electrical connection tab 42, and is therefore not directly electrically connected to the microcontroller 32. Instead, the neutral plate 52 is only electrically connected to the microcontroller 32 through the aqueous medium flowing between adjacent plates. The neutral plate 52 includes fastener through holes 38, inlet flow holes 44, and outlet flow holes 46 as does the first charged plate 40, and such holes fulfil a similar purpose. The major surfaces of the neutral plate 52 may be abraded or scored as is the major surfaces of the first charged plate 50 for a similar purpose. FIG. 4 also shows the elongate chamber boundaries 48 on the major surfaces of the neutral plate 52, and the surface of the neutral plate 52 may be similar to the surface of the other plates discussed herein (recessed or elevated on one or the other side of the elongate chamber boundary 48, or with essentially no difference on either side of the elongate chamber boundary 48). The neutral plate may be formed of a similar material as the material used for the first charged plate 40 and the second charged plate 50, e.g., 316L stainless steel or the like.

Each of the first charged plate 40, the second charged plate 50, and the neutral plate 52 may have any desired thickness. Each of the first charged plate 40, the second charged plate 50, and the neutral plate 52 may have a similar thickness in some embodiments of the stack 34 and electrolysis reactor 24. In one exemplary embodiment, each of the first charged plate 40, the second charged plate 50, and the neutral plate 52 has a thickness of 50 thousandths or 0.050 inches. The thickness may be measured before or after an abrasion or scoring treatment is applied to the major surfaces of the first charged plate 40, the second charged plate 50, and the neutral plate 52.

While the various plates in the electrolysis reactor 24 may have any desired dimensions based on desired characteristics of the electrolysis reactor 24, including overall capacity, one example of dimensions applicable to the various plates may be given with the understanding that the example is illustrative and is not intended to be restrictive. In one example, the end plates 36, the first charged plates 40, the second charged plate 50, and the neutral plates 52 all have a length of approximately eight inches and a width of approximately five and three-quarters inches. In this example, the inlets 26, the outlets 28, the inlet flow holes 44 and the outlet flow holes 46 all have a diameter of approximately one-half inch. In this example, the fastener through holes 38 all have a diameter of approximately one-quarter inch. A space between the edge of the respective plate and the elongate chamber boundary 48 or between adjacent elongate chamber boundaries 48 may be approximately nine-sixteenths of an inch. The fastener through holes 38 may be centrally located within this nine-sixteenths inch boundary, as illustrated in FIGS. 3-7. There may be more or fewer fastener through holes 38 that are illustrated in FIGS. 3-7.

Figure 8:
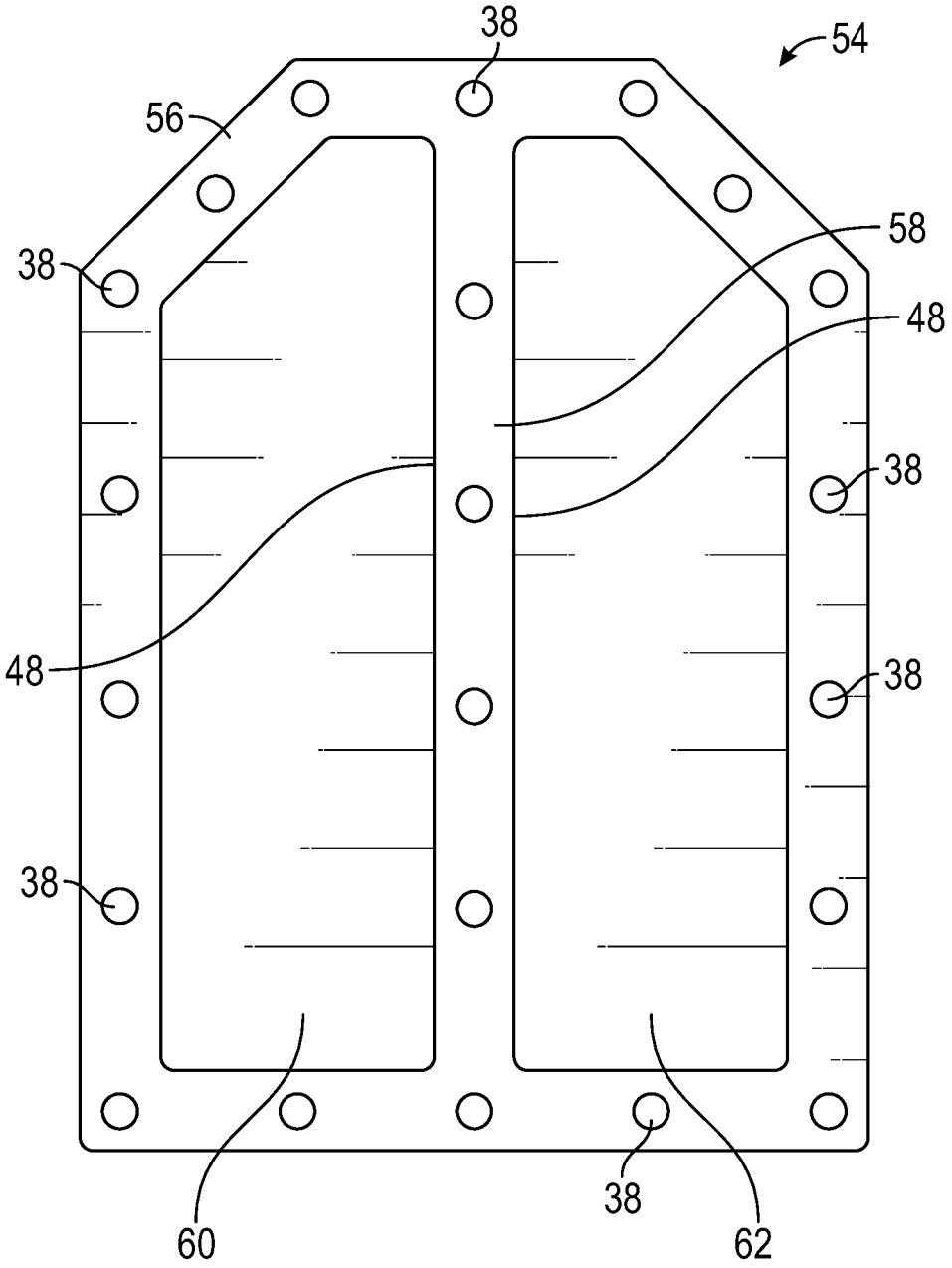
FIG. 8 shows a plan view of a non-compressible spacer for use in a stack of an electrolysis reactor.

FIG. 8 illustrates one embodiment of a non-compressible spacer 54. The spacer 54 may be formed from an incompressible and not electrically conductive plastic material such as polyphthalamide (PPA), high density polyethylene (HDPE), styrene, combinations thereof, and the like. Generally, the spacer 54 is formed of a material that is nonreactive when exposed to the aqueous solution and/or electrical currents/voltages on the order of those supplied by the microcontroller 32. Additionally, the spacer 54 is formed of a material that is stable over a range of temperatures experienced by the electrolysis reactor 24. In certain embodiments, the spacer 54 has a thickness of approximately thirty thousandths or 0.030 inches. The spacer 54 has a border portion 56 extending substantially along an outer edge of the adjacent plates (excepting proximate the electrical connection tab 42. The spacer 54 also has a central divider 58 extending from the top of the spacer 54 to the bottom of the spacer 54. The central divider 58 divides an inter-plate space between immediately adjacent plates into a first elongate chamber 60 and a second elongate chamber 62. The first elongate chamber 60 and the second elongate chamber 62 are fluidically separated by the central divider 58.

In some embodiments, the spacer 54 may include protrusions surrounding each of the fastener through holes 38 extending in a circle around the fastener through holes 38, such that when the stack 34 is assembled, the protrusions extend into the fastener through holes 38 of one or both of the immediately adjacent plates, thereby forming a non-conductive sheath that prevents electrical contact between the plates and the fasteners securing the stack 34 together.

Figure 9:
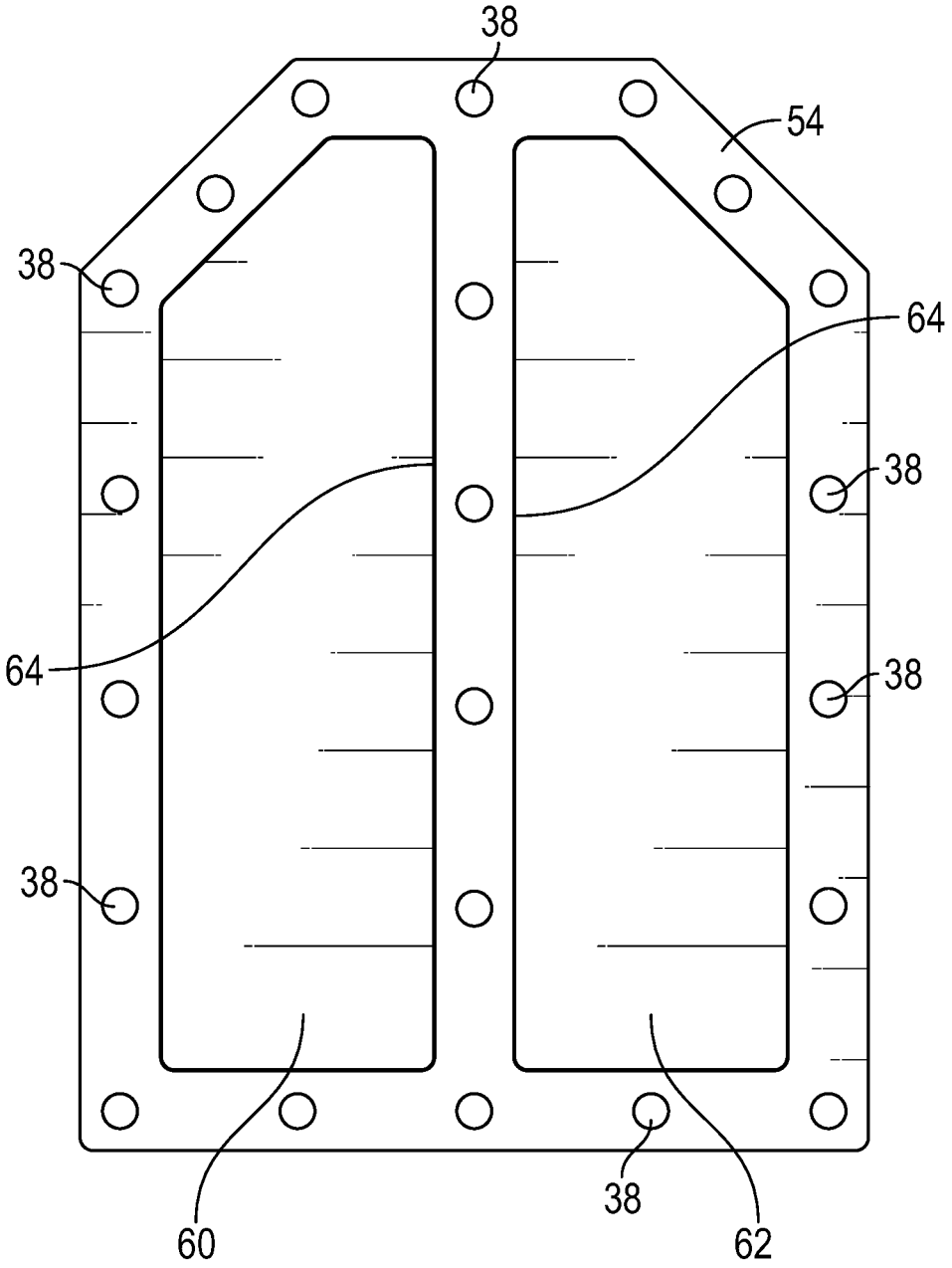
FIG. 9 shows a plan view of a spacer-gasket assembly formed from a non-compressible spacer and a pair of compressible gaskets for use in a stack of an electrolysis reactor.

To further ensure fluidic separation between the first elongate chamber 60 and the second elongate chamber 62 in the assembled stack 34, a compressible gasket 64 is disposed around the edge of each of the first elongate chamber 60 and the second elongate chamber 62, along the inner edges of the spacer 54 as shown in FIG. 9. The compressible gasket 64 is formed from a material that is nonreactive when exposed to the aqueous solution, and has a thickness that is slightly greater than the thickness of the spacer 54. For example, if the spacer 54 has a thickness of thirty thousandths, the gasket 64 may have a thickness of approximately forty thousandths, or 0.040 inches. As the stack 34 is assembled and the fasteners are tightened, the compressible gasket 64 will compress until the immediately adjacent plates fully contact the incompressible spacer 54. At this point, the compressible gaskets 64 form a fluid-tight seal around each of the first elongate chamber 60 and the second elongate chamber 62.

The compressible gaskets 64 may be formed of any desired compressible material. By way of example, the compressible material may be a rubber-like material such as ethylene propylene diene monomer (EPDM).

In the stack 34, a spacer 54 and gasket 64 combination is located between each of the various metal plates. The spacers 54 are all the same thickness and ensure substantially identical spacing between the various metal plates. The gaskets 64 serve to ensure a fluid-tight seal between the various metal plates so that the stack 34 does not leak.

Figure 10:
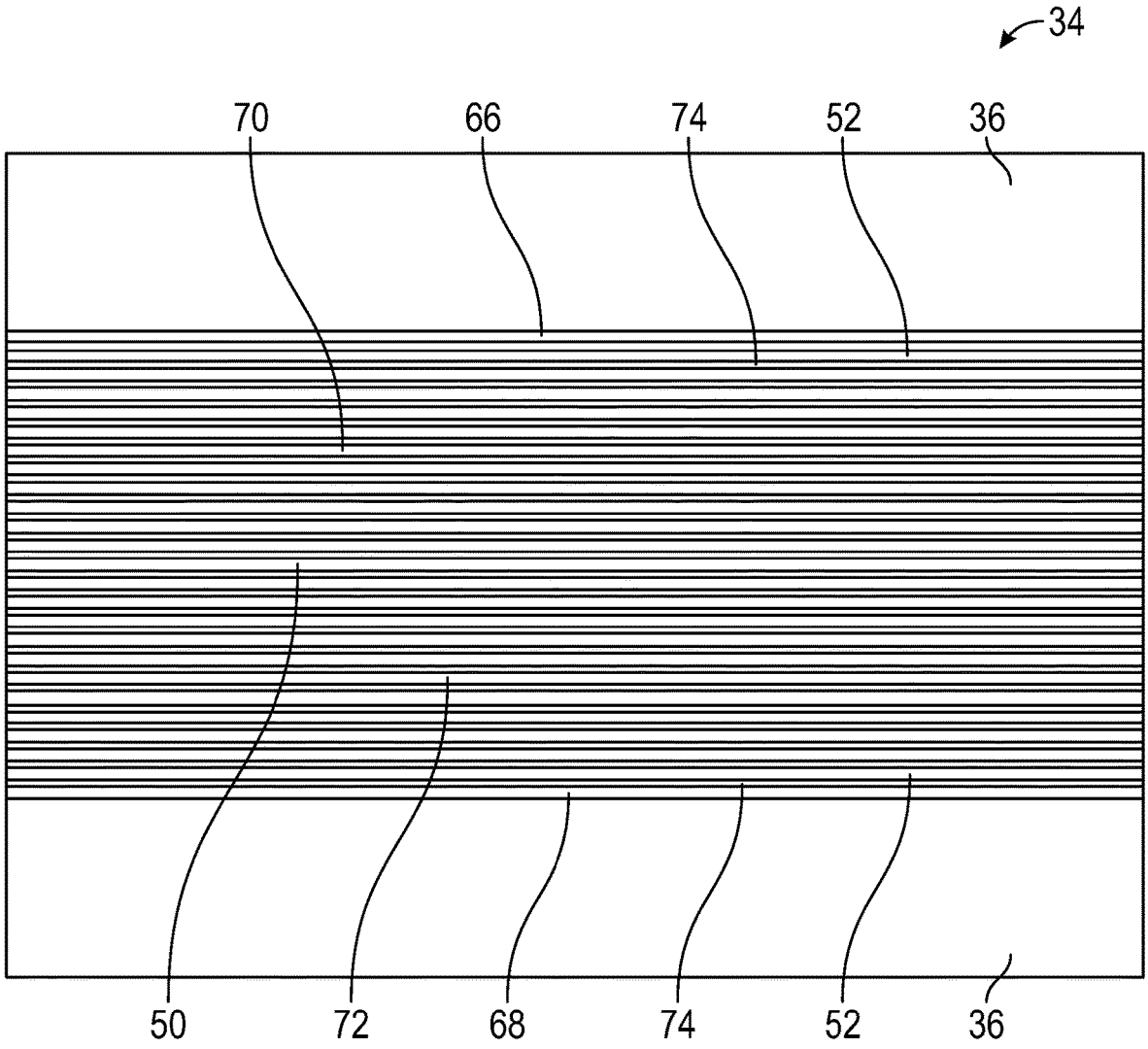
FIG. 10 shows a side view of a stack of an electrolysis reactor.

FIG. 10 illustrates a side view of one embodiment of the stack 34. The stack 34 includes the end plates 36 on either side of the stack. Immediately adjacent each of the end plates 36 is placed one of the first charged plates 40 as a positive plate (e.g. connected to a positive output of the microcontroller 32). Thus, a first positive end plate 66 is adjacent one of the end plates 36, and a second positive end plate 68 is adjacent the other end plate 36. The second charged plate 50 is placed at the center of the stack 34 and serves as a central positive plate (connected to the positive output of the microcontroller 32).

An third first charged plate 40 is located equidistant between the first positive end plate 66 and the second charged plate 50 at the center of the stack 34. This first charged plate 40 serves as a first negative plate 70. A fourth first charged plate 40 is located equidistant between the second positive end plate 68 and the second charged plate 50 at the center of the stack 34, and serves as a second negative plate 72. In this embodiment, five neutral plates 52 are disposed between the first positive end plate 66 and the first negative plate 70, between the first negative plate 70 and the second charged plate 50 at the center of the stack 34, between the second charged plate 50 and the second negative plate 72, and between the second negative plate 72 and the second positive end plate 68. Accordingly, there are a total of twenty neutral plates 52 and there are a total of twenty-five plates in all (including positive, negative, and neutral plates) in this embodiment of the stack 34. There is a spacer-gasket combination 74 between each pair of immediately adjacent metal plates, such that there are a total of twenty-four spacer-gasket combinations 74 in the stack 34 in all.

Using the measurements discussed above for the thickness of the various metal plates, the incompressible spacers 54, and the end plates 36, the embodiment of the stack 34 illustrated in FIG. 10 has a total thickness of approximately three and one-half inches. Accordingly, the assembled stack 34 may have dimensions on the order of approximately eight inches by approximately five and three-quarters inches by approximately three and one-half inches. Other embodiments of the stack 34 may have differing dimensions, such as because of differing heights, widths, and/or thicknesses of the various plates or spacers 54. Other embodiments of the stack 34 may have differing dimension due to having differing numbers of plates, e.g., neutral plates 52 and accompanying spacer 54.

Embodiments of the invention have been tested in a 1990 GMC box truck having a six-cylinder, 6.6-liter diesel engine. The truck had approximately 450,000 miles on it, was underpowered, and was highly polluting. In fact, in an emissions test, the truck exhaust tested as having 71% opacity prior to installation of the test system. Subsequent to installation of the test system, the measured opacity of the truck's emissions immediately decreased to approximately 34%, and one week later, the measured opacity of the truck's emissions was approximately 12%. Recently, the measured opacity of the test vehicle's omissions was 0%. Using the system, the truck's power and top speed have also significantly increased.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A system for improving efficiency of an internal combustion engine, comprising:

an electronic controller generating an alternating-current (AC) signal having a frequency in a range between 10 MHz and 50 MHz and comprising a positive output and a negative output;

an electrolysis reactor electrically connected to the electronic controller and comprising:

a plurality of substantially parallel plates arranged in a stack, the plurality of plates comprising:

a central positive plate centrally located in the stack and electrically connected to the positive output;

a first positive end plate electrically connected to the positive output;

a second positive end plate electrically connected to the positive output;

a first negative plate located in the stack equidistantly between the central positive plate and the first positive end plate and electrically connected to the negative output;

a second negative plate located in the stack equidistantly between the central positive plate and the second positive end plate and electrically connected to the negative output; and a plurality of neutral plates, each neutral plate being disposed between one of the positive plates and one of the negative plates, wherein each of the neutral plates is not electrically connected to either of the positive outlet or the negative outlet by a metallic electric connection; and an aqueous solution flowing through the electrolysis reactor and comprising an electrolyte.

2. The system as recited in claim 1, wherein an electrical connection between the positive output and each of the positive plates comprises an electrical wire between the electronic controller and the electrolysis reactor and an electrical connection between the negative output and each of the negative plates comprises an electrical wire between the electronic controller and the electrolysis reactor.

3. The system as recited in claim 1, wherein each plate in the stack is separated from each immediately adjacent plate in the stack by an incompressible non-conductive spacer.

4. The system as recited in claim 3, wherein each spacer comprises a border portion extending along an outer edge of its adjacent plates, and a central divider extending from one side of the spacer to an opposite side of the spacer and dividing an inter-plate space between immediately adjacent plates into two fluidly separate elongate chambers.

5. The system as recited in claim 4, wherein each plate except the central positive plate comprises four fluid passage holes, with one fluid passage hole being disposed at a first end of each elongate chamber, and with one fluid passage hole being disposed at a second end of each elongate chamber.

6. The system as recited in claim 5, wherein the central positive plate is substantially impermeable to passage of fluid.

7. The system as recited in claim 5, further comprising a fluid-tight gasket disposed around an edge of each elongate chamber between immediately adjacent plates.

8. The system as recited in claim 1, further comprising a pump fluidically connected to the electrolysis reactor to circulate the aqueous solution through the electrolysis reactor, the pump being of a type having electrical components electrically insulated from the aqueous solution passed through the pump.

9. The system as recited in claim 8, wherein the pump has no metal parts in contact with the aqueous solution.

10. The system as recited in claim 8, wherein the pump is a diaphragm pump.

11. The system as recited in claim 1, wherein the AC signal has a frequency of between 26 and 36 MHz.

12. The system as recited in claim 1, wherein all components of the system exposed to the aqueous solution are electrically insulated from a vehicle containing the system, such that the only electrical input to or electrical output from the aqueous solution occurs at the stack of plates where the output of the electronic controller is received.

13. A system for improving efficiency of an internal combustion engine, comprising:

an electronic controller generating an alternating-current (AC) signal having a frequency in a range between 26 MHz and 36 MHz and comprising a positive output and a negative output;

an electrolysis reactor electrically connected to the electronic controller and comprising:

a plurality of substantially parallel plates arranged in a stack, the plurality of plates comprising:

a central positive plate centrally located in the stack and electrically connected to the positive output;

a first positive end plate electrically connected to the positive output;

a second positive end plate electrically connected to the positive output;

a first negative plate located in the stack equidistantly between the central positive plate and the first positive end plate and electrically connected to the negative output;

a second negative plate located in the stack equidistantly between the central positive plate and the second positive end plate and electrically connected to the negative output; and a plurality of neutral plates, each neutral plate being disposed between one of the positive plates and one of the negative plates, wherein each of the neutral plates is not electrically connected to either of the positive outlet or the negative outlet by a metallic electric connection; and a plurality of incompressible non-conductive spacers, with one non-conductive spacer disposed between each pair of immediately adjacent plates, each spacer comprising:

a border portion extending along an outer edge of its adjacent plates; and a central divider extending from one side of the spacer to an opposite side of the spacer and dividing an inter-plate space between immediately adjacent plates into two fluidly separate elongate chambers; and an aqueous solution flowing through the electrolysis reactor, the aqueous solution comprising an electrolyte.

14. The system as recited in claim 13, further comprising a fluid-tight compressible gasket disposed around an edge of each elongate chamber between immediately adjacent plates.

15. The system as recited in claim 13, wherein each plate except the central positive plate comprises four fluid passage holes, with one fluid passage hole being disposed at a first end of each elongate chamber, and with one fluid passage hole being disposed at a second end of each elongate chamber, and wherein the central positive plate is substantially impermeable to passage of fluid from any elongate chamber.

16. The system as recited in claim 15, further comprising a diaphragm pump fluidically connected to the fluid passage holes of the first positive end plate and the second positive plate, whereby the diaphragm pump circulates the aqueous solution through four sub-cells of the electrolysis reactor, beginning and ending for two sub-cells with the fluid passage holes of the first positive end plate and beginning and ending for two other sub-cells with the fluid passage holes of the second positive end plate.

17. The system as recited in claim 16, further comprising:

a tank storing a quantity of the aqueous solution and having a gaseous space above a liquid level in the tank;

a supply fluid circulation path between a lower end of the tank and the electrolysis reactor;

a return fluid circulation path between the electrolysis reactor and an upper end the tank; and an engine supply line extending from the gaseous space of the tank to an engine inlet of an internal combustion engine, the engine supply line including a scrubber to remove liquid from a fluid flowing to the engine inlet from the tank.

18. The system as recited in claim 17, wherein the tank is in close proximity to and vertically spaced above the electrolysis reactor, and wherein the tank is in close proximity to the internal combustion engine.

19. A method for improving efficiency of an internal combustion engine, the method comprising:

providing an electrolysis reactor in close proximity to an internal combustion engine, the electrolysis reactor comprising:

a plurality of substantially parallel plates arranged in a stack, the plurality of plates comprising:

a central positive plate centrally located in the stack and electrically connected to the positive output;

a first positive end plate electrically connected to the positive output;

a second positive end plate electrically connected to the positive output;

a first negative plate located in the stack equidistantly between the central positive plate and the first positive end plate and electrically connected to the negative output;

a second negative plate located in the stack equidistantly between the central positive plate and the second positive end plate and electrically connected to the negative output; and a plurality of neutral plates, each neutral plate being disposed between one of the positive plates and one of the negative plates, wherein each of the neutral plates is not electrically connected to either of the positive outlet or the negative outlet by a metallic electric connection; and a plurality of incompressible non-conductive spacers, with one non-conductive spacer disposed between each pair of immediately adjacent plates, each spacer comprising:

a border portion extending along an outer edge of its adjacent plates; and a central divider extending from one side of the spacer to an opposite side of the spacer and dividing an inter-plate space between immediately adjacent plates into two fluidly separate elongate chambers;

supplying an alternating-current (AC) signal having a frequency in a range between 26 MHz and 36 MHz between the various positive and the various negative plates;

flowing an aqueous solution comprising an electrolyte through the electrolysis reactor, whereby a water electrolysis product is formed in the solution; and delivering the water electrolysis product to an intake of the internal combustion engine.

20. The method as recited in claim 19, further comprising controlling an amperage of the AC signal to prevent heat runaway of the aqueous solution.

* * * * *